US006996348B2

(12) United States Patent
Inaba

(10) Patent No.: US 6,996,348 B2
(45) Date of Patent: Feb. 7, 2006

(54) IMAGE FORMING DEVICE PROVIDING USER WITH METHOD FOR CLEARING ERRORS

(75) Inventor: Michio Inaba, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 224 days.

(21) Appl. No.: 10/670,339

(22) Filed: Sep. 26, 2003

(65) Prior Publication Data

US 2004/0136736 A1 Jul. 15, 2004

(30) Foreign Application Priority Data

Sep. 26, 2002 (JP) ..... P2002-281936

(51) Int. Cl.
*G03G 15/00* (2006.01)
*B65H 63/00* (2006.01)

(52) U.S. Cl. ..... 399/16; 399/19; 399/38; 399/81

(58) Field of Classification Search ..... 399/16, 399/18, 19, 38
See application file for complete search history.

(56) References Cited

U.S. PATENT DOCUMENTS 5,583,617 A * 12/1996 Altrieth et al. ..... 399/81
6,356,719 B1 3/2002 Yoshiura ..... 399/45
6,608,974 B2 * 8/2003 Kurita ..... 399/13
2003/0026619 A1 * 2/2003 Miyoshi et al. ..... 399/19
2004/0213590 A1 * 10/2004 Schroath et al. ..... 399/21
2005/0111015 A1 * 5/2005 Tsujimoto ..... 358/406 X

FOREIGN PATENT DOCUMENTS

| | | |
|---|---|---|
| JP | A 63-217370 | 9/1988 |
| JP | A 11-275304 | 10/1999 |
| JP | B2 3175479 | 4/2001 |
| JP | 2001-134147 | 5/2001 |

* cited by examiner

*Primary Examiner*—Sophia S. Chen
(74) *Attorney, Agent, or Firm*—Oliff & Berridge, PLC

(57) ABSTRACT

A laser printer is equipped with a device for conveying a recording medium, the device being capable of detecting errors that might occur along each possible conveying path and the total number of steps involved in error resolution methods stored in an error table and capable of storing this data along with the conveying paths. The device sorts the conveying paths in order beginning from the error resolution methods involving the least total number of steps and updates the error table to reflect this order. The device then displays at least one resolution method based on the updated error table, along with the conveying path and total number of steps required to perform each resolution method.

25 Claims, 34 Drawing Sheets

FIG.6

100

| SHEET SIZE | FIRST PAPER SUPPLY TRAY 11A | SECOND PAPER SUPPLY TRAY 11B | THIRD PAPER SUPPLY TRAY 11C | FOURTH PAPER SUPPLY TRAY 11D | DUPLEX PRINTING UNIT 25 | FIRST DISCHARGE TRAY 30 | SECOND DISCHARGE TRAY 31 | STAPLE |
|---|---|---|---|---|---|---|---|---|
| A3 | ○ | ○ | ○ | ○ | ○ | ○ | × | × |
| B4 | ○ | ○ | ○ | ○ | ○ | ○ | × | ○ |
| LEGAL | ○ | ○ | ○ | ○ | ○ | ○ | × | ○ |
| A4 | ○ | ○ | ○ | ○ | ○ | ○ | ○ | ○ |
| LETTER | ○ | ○ | ○ | ○ | ○ | ○ | ○ | ○ |
| B5 | ○ | ○ | ○ | ○ | ○ | ○ | × | ○ |

○ ··· POSSIBLE
× ··· NOT POSSIBLE

FIG.7

110

| SHEET TYPE | FIRST PAPER SUPPLY TRAY 11A | SECOND PAPER SUPPLY TRAY 11B | THIRD PAPER SUPPLY TRAY 11C | FOURTH PAPER SUPPLY TRAY 11D | DUPLEX PRINTING UNIT 25 | FIRST DISCHARGE TRAY 30 | SECOND DISCHARGE TRAY 31 | STAPLE |
|---|---|---|---|---|---|---|---|---|
| NORMAL SHEET | ○ | ○ | ○ | ○ | ○ | ○ | ○ | ○ |
| THICK SHEET | ○ | ○ | × | × | ○ | ○ | × | × |
| TRANSPARENT SHEET | ○ | × | × | × | × | ○ | × | × |

○ ··· POSSIBLE
× ··· NOT POSSIBLE

FIG.8

120

| FROM \ TO | DUPLEX PRINTING UNIT | FIRST DISCHARGE TRAY 30 | SECOND DISCHARGE TRAY 31 | STAPLER 35 |
|---|---|---|---|---|
| FIRST PAPER SUPPLY TRAY 11A | ○ | ○ | ○ | ○ |
| SECOND PAPER SUPPLY TRAY 11B | ○ | ○ | ○ | ○ |
| THIRD PAPER SUPPLY TRAY 11C | ○ | ○ | ○ | ○ |
| FOURTH PAPER SUPPLY TRAY 11D | × | ○ | × | × |
| DUPLEX PRINTING UNIT | × | ○ | ○ | ○ |
| STAPLER 35 | × | × | ○ | × |

○ ··· POSSIBLE
× ··· NOT POSSIBLE

FIG.9

130

| ERROR NUMBER | ERROR CAUSE | RESOLUTION METHOD | NUMBER OF STEPS |
|---|---|---|---|
| 1 | FIRST DISCHARGE TRAY 30 IS FULL | REMOVE RECORDING SHEET FROM FIRST DISCHARGE TRAY 30 | 1 |
| 2 | SECOND DISCHARGE TRAY 31 IS FULL | REMOVE RECORDING SHEET FROM SECOND DISCHARGE TRAY 31 | 1 |
| 3 | FIRST PAPER SUPPLYING TRAY 11A IS OUT OF PAPER | LOAD RECORDING SHEET IN FIRST PAPER SUPPLYING TRAY 11A | 3 |
| 4 | SECOND PAPER SUPPLY TRAY 11B IS OUT OF PAPER | LOAD RECORDING SHEET IN SECOND PAPER SUPPLY TRAY 11B | 3 |
| 5 | THIRD PAPER SUPPLY TRAY 11C IS OUT OF PAPER | LOAD RECORDING SHEET IN THIRD PAPER SUPPLY TRAY 11C | 3 |
| 6 | FOURTH PAPER SUPPLY TRAY 11D IS OUT OF PAPER | LOAD RECORDING SHEET IN FOURTH PAPER SUPPLY TRAY 11D | 3 |
| 7 | INCORRECT PAPER TYPE IN FIRST PAPER SUPPLYING TRAY 11A | REPLACE RECORDING SHEET IN FIRST PAPER SUPPLYING TRAY 11A WITH DIFFERENT TYPE | 4 |
| 8 | INCORRECT PAPER TYPE IN SECOND PAPER SUPPLY TRAY 11B | REPLACE RECORDING SHEET IN SECOND PAPER SUPPLY TRAY 11B WITH DIFFERENT TYPE | 4 |
| 9 | INCORRECT PAPER TYPE IN THIRD PAPER SUPPLY TRAY 11C | REPLACE RECORDING SHEET IN THIRD PAPER SUPPLY TRAY 11C WITH DIFFERENT TYPE | 4 |
| 10 | INCORRECT PAPER TYPE IN FOURTH PAPER SUPPLY TRAY 11D | REPLACE RECORDING SHEET IN FOURTH PAPER SUPPLY TRAY 11D WITH DIFFERENT TYPE | 4 |
| 11 | INCORRECT PAPER SIZE IN FIRST PAPER SUPPLYING TRAY 11A | REPLACE RECORDING SHEET IN FIRST PAPER SUPPLYING TRAY 11A WITH DIFFERENT SIZE | 5 |
| 12 | INCORRECT PAPER SIZE IN SECOND PAPER SUPPLY TRAY 11B | REPLACE RECORDING SHEET IN SECOND PAPER SUPPLY TRAY 11B WITH DIFFERENT SIZE | 5 |
| 13 | INCORRECT PAPER SIZE IN THIRD PAPER SUPPLY TRAY 11C | REPLACE RECORDING SHEET IN THIRD PAPER SUPPLY TRAY 11C WITH DIFFERENT SIZE | 5 |
| 14 | INCORRECT PAPER SIZE IN FOURTH PAPER SUPPLY TRAY 11D | REPLACE RECORDING SHEET IN FOURTH PAPER SUPPLY TRAY 11D WITH DIFFERENT SIZE | 5 |
| 15 | COVER OPEN ON DUPLEX PRINTING UNIT 25 | CLOSE COVER ON DUPLEX PRINTING UNIT 25 | 1 |
| 16 | OUT OF STAPLES | LOAD STAPLES | 6 |

FIG.10(a)

140

EX. 1

| USER-SPECIFIED PRINTING CONDITIONS | | | | | |
|---|---|---|---|---|---|
| PAPER SUPPLY TRAY SPECIFICATION | SIZE SPECIFICATION | TYPE SPECIFICATION | PRINTING SURFACE SPECIFICATION | BINDING SPECIFICATION | DISCHARGE TRAY SPECIFICATION |
| NONE | B5 | NORMAL PAPER | ONE SIDE | NO | NONE |

FIG.10(b)

140

EX. 2

| USER-SPECIFIED PRINTING CONDITIONS | | | | | |
|---|---|---|---|---|---|
| PAPER SUPPLY TRAY SPECIFICATION | SIZE SPECIFICATION | TYPE SPECIFICATION | PRINTING SURFACE SPECIFICATION | BINDING SPECIFICATION | DISCHARGE TRAY SPECIFICATION |
| NONE | B5 | NORMAL PAPER | BOTH SIDES | YES | NONE |

FIG.11

150

| | STATUS OF PAPER SUPPLY TRAY | | |
|---|---|---|---|
| | PAPER SIZE | PAPER TYPE | PAPER LOADED? |
| FIRST PAPER SUPPLYING TRAY 11A | B5 | TRANSPARENCY | YES |
| SECOND PAPER SUPPLY TRAY 11B | A4 | NORMAL PAPER | YES |
| THIRD PAPER SUPPLY TRAY 11C | B5 | NORMAL PAPER | NO |
| FOURTH PAPER SUPPLY TRAY 11D | B5 | NORMAL PAPER | YES |

FIG.12

160

| | STATUS OF DISCHARGE TRAY |
|---|---|
| FIRST DISCHARGE TRAY 30 | FULL |
| SECOND DISCHARGE TRAY 31 | NOT FULL |

FIG.13

170

| | COVER STATUS |
|---|---|
| DUPLEX PRINTING UNIT | CLOSED |

FIG.14

180

| | STAPLES? |
|---|---|
| STAPLER | YES |

FIG.15

190

| NO. | CONVEYING PATH | | | |
|---|---|---|---|---|
| | PAPER SUPPLY TRAY | DUPLEX PRINTING UNIT | STAPLER | DISCHARGE TRAY |
| 1 | 1 | USED | NOT USED | 1 |
| 2 | 1 | USED | NOT USED | 2 |
| 3 | 2 | USED | NOT USED | 1 |
| 4 | 2 | USED | NOT USED | 2 |
| 5 | 1 | NOT USED | NOT USED | 1 |
| 6 | 1 | NOT USED | NOT USED | 2 |
| 7 | 2 | NOT USED | NOT USED | 1 |
| 8 | 2 | NOT USED | NOT USED | 2 |
| 9 | 3 | NOT USED | NOT USED | 1 |
| 10 | 3 | NOT USED | NOT USED | 2 |
| 11 | 4 | NOT USED | NOT USED | 1 |
| 12 | 1 | USED | USED | 2 |
| 13 | 2 | USED | USED | 2 |
| 14 | 1 | NOT USED | USED | 2 |
| 15 | 2 | NOT USED | USED | 2 |
| 16 | 3 | NOT USED | USED | 2 |

WHEN FINISHING DEVICE IS PROVIDED

FIG.16

200

| NO. | CONVEYING PATH | | | |
|---|---|---|---|---|
| | PAPER SUPPLY TRAY | DUPLEX PRINTING UNIT | STAPLER | DISCHARGE TRAY |
| 1 | 1 | USED | NOT USED | 1 |
| 3 | 2 | USED | NOT USED | 1 |
| 5 | 1 | NOT USED | NOT USED | 1 |
| 7 | 2 | NOT USED | NOT USED | 1 |
| 9 | 3 | NOT USED | NOT USED | 1 |
| 11 | 4 | NOT USED | NOT USED | 1 |

WHEN FINISHING DEVICE IS NOT PROVIDED

FIG.21

210

| | DEVICE CAPACITY ERRORS | | DEVICE STATUS ERRORS | | | | | |
|---|---|---|---|---|---|---|---|---|
| NO | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 5 | NONE | 0 | INCORRECT TYPE | — | — | FULL | 1, 7 | 5 |
| 6 | NONE | 0 | INCORRECT TYPE | — | — | ○ | 7 | 4 |
| 7 | NONE | 0 | INCORRECT SIZE | — | — | FULL | 1, 12 | 6 |
| 8 | NONE | 0 | INCORRECT SIZE | — | — | ○ | 12 | 5 |
| 9 | NONE | 0 | OUT OF PAPER | — | — | FULL | 1, 5 | 4 |
| 10 | NONE | 0 | OUT OF PAPER | — | — | ○ | 5 | 3 |
| 11 | NONE | 0 | ○ | — | — | FULL | 1 | 1 |

FIG.22

210b

| | DEVICE CAPACITY ERRORS | | DEVICE STATUS ERRORS | | | | | |
|---|---|---|---|---|---|---|---|---|
| NO. | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 11 | NONE | 0 | ○ | — | — | FULL | 1 | 1 |
| 10 | NONE | 0 | OUT OF PAPER | — | — | ○ | 5 | 3 |
| 6 | NONE | 0 | INCORRECT TYPE | — | — | ○ | 7 | 4 |
| 9 | NONE | 0 | OUT OF PAPER | — | — | FULL | 1, 5 | 4 |
| 5 | NONE | 0 | INCORRECT TYPE | — | — | FULL | 1, 7 | 5 |
| 8 | NONE | 0 | INCORRECT SIZE | — | — | ○ | 12 | 5 |
| 7 | NONE | 0 | INCORRECT SIZE | — | — | FULL | 1, 12 | 6 |

FIG.23

210c

| | DEVICE CAPACITY ERRORS | | DEVICE STATUS ERRORS | | | | | |
|---|---|---|---|---|---|---|---|---|
| NO. | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 11 | NONE | 0 | ○ | — | — | FULL | 1 | 1 |
| 10 | NONE | 0 | OUT OF PAPER | — | — | ○ | 5 | 3 |
| 6 | NONE | 0 | INCORRECT TYPE | — | — | ○ | 7 | 4 |
| 8 | NONE | 0 | INCORRECT SIZE | — | — | ○ | 12 | 5 |

FIG.25

210(210d)

| | DEVICE CAPACITY ERRORS | | DEVICE STATUS ERRORS | | | | | |
|---|---|---|---|---|---|---|---|---|
| NO. | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 12 | NONE | 0 | INCORRECT TYPE | ○ | ○ | ○ | 7 | 4 |
| 13 | NONE | 0 | INCORRECT SIZE | ○ | ○ | ○ | 12 | 5 |
| 14 | PRINTING SURFACE SPECIFICATION | 1 | INCORRECT TYPE | — | ○ | ○ | 7 | 4 |
| 15 | PRINTING SURFACE SPECIFICATION | 1 | INCORRECT SIZE | — | ○ | ○ | 12 | 5 |
| 16 | PRINTING SURFACE SPECIFICATION | 1 | OUT OF PAPER | — | — | ○ | 5 | 3 |

FIG.26

210e

| | DEVICE CAPACITY ERRORS | | DEVICE STATUS ERRORS | | | | | |
|---|---|---|---|---|---|---|---|---|
| NO. | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 12 | NONE | 0 | INCORRECT TYPE | ○ | ○ | ○ | 7 | 4 |
| 13 | NONE | 0 | INCORRECT SIZE | ○ | ○ | ○ | 12 | 5 |
| 16 | PRINTING SURFACE SPECIFICATION | 1 | OUT OF PAPER | — | — | ○ | 5 | 3 |
| 14 | PRINTING SURFACE SPECIFICATION | 1 | INCORRECT TYPE | — | ○ | ○ | 7 | 4 |
| 15 | PRINTING SURFACE SPECIFICATION | 1 | INCORRECT SIZE | — | ○ | ○ | 12 | 5 |

FIG.27

210f

| | DEVICE CAPACITY ERRORS | | DEVICE STATUS ERRORS | | | | | |
|---|---|---|---|---|---|---|---|---|
| NO. | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 12 | NONE | 0 | INCORRECT TYPE | ○ | ○ | ○ | 7 | 4 |
| 13 | NONE | 0 | INCORRECT SIZE | ○ | ○ | ○ | 12 | 5 |
| 16 | PRINTING SURFACE SPECIFICATION | 1 | OUT OF PAPER | — | — | ○ | 5 | 3 |

FIG.29

210g

| | DEVICE CAPACITY ERRORS | | DEVICE STATUS ERRORS | | | | | |
|---|---|---|---|---|---|---|---|---|
| NO. | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 1 | BINDING SPECIFICATION | 1 | INCORRECT TYPE | O | — | FULL | 1, 7 | 5 |
| 2 | BINDING SPECIFICATION | 1 | INCORRECT TYPE | O | — | O | 7 | 4 |
| 3 | BINDING SPECIFICATION | 1 | INCORRECT SIZE | O | — | FULL | 1, 12 | 6 |
| 4 | BINDING SPECIFICATION | 1 | INCORRECT SIZE | O | — | O | 12 | 5 |
| 5 | PRINTING SURFACE SPECIFICATION, BINDING SPECIFICATION | 2 | INCORRECT TYPE | — | — | FULL | 1, 7 | 5 |
| 6 | PRINTING SURFACE SPECIFICATION, BINDING SPECIFICATION | 2 | INCORRECT TYPE | — | — | O | 7 | 4 |
| 7 | PRINTING SURFACE SPECIFICATION, BINDING SPECIFICATION | 2 | INCORRECT SIZE | — | — | FULL | 1, 12 | 6 |
| 8 | PRINTING SURFACE SPECIFICATION, BINDING SPECIFICATION | 2 | INCORRECT SIZE | — | — | O | 12 | 5 |
| 9 | PRINTING SURFACE SPECIFICATION, BINDING SPECIFICATION | 2 | OUT OF PAPER | — | — | FULL | 1, 5 | 4 |
| 10 | PRINTING SURFACE SPECIFICATION, BINDING SPECIFICATION | 2 | OUT OF PAPER | — | — | O | 5 | 3 |
| 11 | PRINTING SURFACE SPECIFICATION, BINDING SPECIFICATION | 2 | O | — | — | FULL | 1 | 1 |
| 12 | NONE | 0 | INCORRECT TYPE | O | O | O | 7 | 4 |
| 13 | NONE | 0 | INCORRECT SIZE | O | O | O | 12 | 5 |
| 14 | PRINTING SURFACE SPECIFICATION | 1 | INCORRECT TYPE | — | O | O | 7 | 4 |
| 15 | PRINTING SURFACE SPECIFICATION | 1 | INCORRECT SIZE | — | O | O | 12 | 5 |
| 16 | PRINTING SURFACE SPECIFICATION | 1 | OUT OF PAPER | — | — | O | 5 | 3 |

FIG.30

210h

| | DEVICE CAPACITY ERRORS | | DEVICE STATUS ERRORS | | | | | |
|---|---|---|---|---|---|---|---|---|
| NO. | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 12 | NONE | 0 | INCORRECT TYPE | O | O | O | 7 | 4 |
| 13 | NONE | 0 | INCORRECT SIZE | O | O | O | 12 | 5 |
| 16 | PRINTING SURFACE SPECIFICATION | 1 | OUT OF PAPER | — | — | O | 5 | 3 |
| 2 | BINDING SPECIFICATION | 1 | INCORRECT TYPE | O | — | O | 7 | 4 |
| 14 | PRINTING SURFACE SPECIFICATION | 1 | INCORRECT TYPE | — | O | O | 7 | 4 |
| 1 | BINDING SPECIFICATION | 1 | INCORRECT TYPE | O | — | FULL | 1, 7 | 5 |
| 4 | BINDING SPECIFICATION | 1 | INCORRECT SIZE | O | — | O | 12 | 5 |
| 15 | PRINTING SURFACE SPECIFICATION | 1 | INCORRECT SIZE | — | O | O | 12 | 5 |
| 3 | BINDING SPECIFICATION | 1 | INCORRECT SIZE | O | — | FULL | 1, 12 | 6 |
| 11 | PRINTING SURFACE SPECIFICATION, BINDING SPECIFICATION | 2 | O | — | — | FULL | 1 | 1 |
| 10 | PRINTING SURFACE SPECIFICATION, BINDING SPECIFICATION | 2 | OUT OF PAPER | — | — | O | 5 | 3 |
| 6 | PRINTING SURFACE SPECIFICATION, BINDING SPECIFICATION | 2 | INCORRECT TYPE | — | — | O | 7 | 4 |
| 9 | PRINTING SURFACE SPECIFICATION, BINDING SPECIFICATION | 2 | OUT OF PAPER | — | — | FULL | 1, 5 | 4 |
| 5 | PRINTING SURFACE SPECIFICATION, BINDING SPECIFICATION | 2 | INCORRECT TYPE | — | — | FULL | 1, 7 | 5 |
| 8 | PRINTING SURFACE SPECIFICATION, BINDING SPECIFICATION | 2 | INCORRECT SIZE | — | — | O | 12 | 5 |
| 7 | PRINTING SURFACE SPECIFICATION, BINDING SPECIFICATION | 2 | INCORRECT SIZE | — | — | FULL | 1, 12 | 6 |

FIG.31

210i

| | DEVICE CAPACITY ERRORS | | DEVICE STATUS ERRORS | | | | | |
|---|---|---|---|---|---|---|---|---|
| NO. | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 12 | NONE | 0 | INCORRECT TYPE | ○ | ○ | ○ | 7 | 4 |
| 13 | NONE | 0 | INCORRECT SIZE | ○ | ○ | ○ | 12 | 5 |
| 16 | PRINTING SURFACE SPECIFICATION | 1 | OUT OF PAPER | — | — | ○ | 5 | 3 |
| 11 | PRINTING SURFACE SPECIFICATION, BINDING SPECIFICATION | 2 | ○ | — | — | FULL | 1 | 1 |

FIG.32

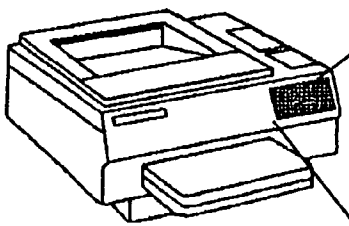

ERROR

RESOLUTION METHOD 1: PLEASE REPLACE THE SHEET IN THE FIRST SHEET SUPPLY TRAY WITH NORMAL SHEET
CAUSE: INCORRECT SHEET TYPE IN THE SHEET SUPPLY TRAY
PATH: FIRST SHEET SUPPLY TRAY → DUPLEX UNIT → STAPLER → SECOND DISCHARGE TRAY
NUMBER OF STEPS: 4

RESOLUTION METHOD 2: PLEASE REPLACE THE SHEET IN THE SECOND SHEET SUPPLY TRAY WITH B5-SIZE SHEET
CAUSE: INCORRECT SHEET SIZE IN THE SHEET SUPPLY TRAY
PATH: SECOND SHEET SUPPLY TRAY → DUPLEX UNIT → STAPLER → SECOND DISCHARGE TRAY
NUMBER OF STEPS: 5

RESOLUTION METHOD 3: PLEASE LOAD SHEET INTO THE THIRD SHEET SUPPLY TRAY
CAUSE: SHEET SUPPLY TRAY IS OUT OF SHEET
RESTRICTION: DUPLEX PRINT UNAVAILABLE
PATH: THIRD SHEET SUPPLY TRAY → STAPLER → SECOND DISCHARGE TRAY
NUMBER OF STEPS: 3

RESOLUTION METHOD 4: PLEASE REMOVE THE SHEET IN THE FIRST DISCHARGE TRAY
CAUSE: DISCHARGE TRAY IS FULL
RESTRICTION: DUPLEX PRINTING UNAVAILABLE; BINDING UNAVAILABLE
PATH: FOURTH SHEET SUPPLY TRAY → FIRST DISCHARGE TRAY
NUMBER OF STEPS: 1

FIG.33

210j

| | DEVICE CAPACITY ERRORS | | DEVICE STATUS ERRORS | | | | | |
|---|---|---|---|---|---|---|---|---|
| NO. | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 5 | NONE | 0 | INCORRECT TYPE | — | — | FULL | 1, 7 | 5 |
| 7 | NONE | 0 | INCORRECT SIZE | — | — | FULL | 1, 12 | 6 |
| 9 | NONE | 0 | OUT OF PAPER | — | — | FULL | 1, 5 | 4 |
| 11 | NONE | 0 | ○ | — | — | FULL | 1 | 1 |

FIG.34

210k

| | DEVICE CAPACITY ERRORS | | DEVICE STATUS ERRORS | | | | | |
|---|---|---|---|---|---|---|---|---|
| NO. | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 11 | NONE | 0 | O | — | — | FULL | 1 | 1 |
| 9 | NONE | 0 | OUT OF PAPER | — | — | FULL | 1, 5 | 4 |
| 5 | NONE | 0 | INCORRECT TYPE | — | — | FULL | 1, 7 | 5 |
| 7 | NONE | 0 | INCORRECT SIZE | — | — | FULL | 1, 12 | 6 |

FIG.35

210m

| | DEVICE CAPACITY ERRORS | | DEVICE STATUS ERRORS | | | | | |
|---|---|---|---|---|---|---|---|---|
| NO. | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 11 | NONE | 0 | O | — | — | FULL | 1 | 1 |

210n

| NO. | DEVICE CAPACITY ERRORS | | DEVICE STATUS ERRORS | | | | | | |
|---|---|---|---|---|---|---|---|---|---|
| | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |

FIG.39

210o

| NO. | DEVICE CAPACITY ERRORS | | DEVICE STATUS ERRORS | | | | | | |
|---|---|---|---|---|---|---|---|---|---|
| | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |

FIG.40

210p

| NO. | DEVICE CAPACITY ERRORS | | DEVICE STATUS ERRORS | | | | | | |
|---|---|---|---|---|---|---|---|---|---|
| | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |

FIG.41

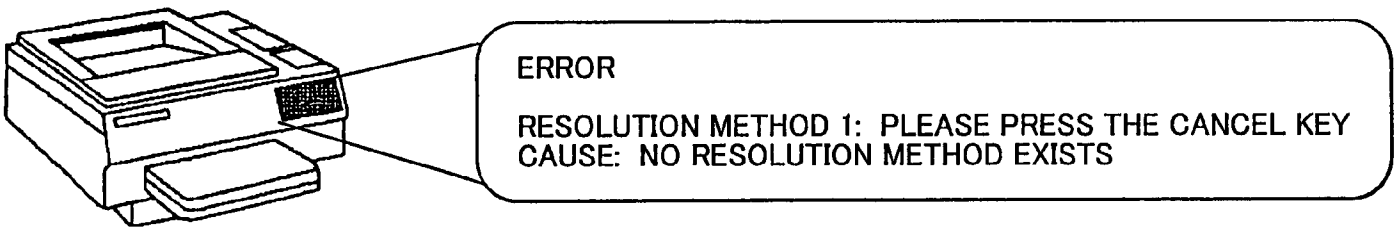

FIG.42

210q

| | DEVICE CAPACITY ERRORS | | DEVICE STATUS ERRORS | | | | | |
|---|---|---|---|---|---|---|---|---|
| NO. | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 1 | BINDING SPECIFICATION | 1 | INCORRECT TYPE | ○ | — | ○ | 7 | 4 |
| 2 | BINDING SPECIFICATION | 1 | INCORRECT TYPE | ○ | — | ○ | 7 | 4 |
| 3 | BINDING SPECIFICATION | 1 | INCORRECT SIZE | ○ | — | ○ | 12 | 5 |
| 4 | BINDING SPECIFICATION | 1 | INCORRECT SIZE | ○ | — | ○ | 12 | 5 |
| 5 | PRINTING SURFACE SPECIFICATION, BINDING SPECIFICATION | 2 | INCORRECT TYPE | — | — | ○ | 7 | 4 |
| 6 | PRINTING SURFACE SPECIFICATION, BINDING SPECIFICATION | 2 | INCORRECT TYPE | — | — | ○ | 7 | 4 |
| 7 | PRINTING SURFACE SPECIFICATION, BINDING SPECIFICATION | 2 | INCORRECT SIZE | — | — | ○ | 12 | 5 |
| 8 | PRINTING SURFACE SPECIFICATION, BINDING SPECIFICATION | 2 | INCORRECT SIZE | — | — | ○ | 12 | 5 |
| 9 | PRINTING SURFACE SPECIFICATION, BINDING SPECIFICATION | 2 | OUT OF PAPER | — | — | ○ | 15 | 3 |
| 10 | PRINTING SURFACE SPECIFICATION, BINDING SPECIFICATION | 2 | OUT OF PAPER | — | — | ○ | 5 | 3 |
| 11 | PRINTING SURFACE SPECIFICATION, BINDING SPECIFICATION | 2 | ○ | — | — | ○ | — | 0 |
| 12 | NONE | 0 | INCORRECT TYPE | ○ | ○ | ○ | 7 | 4 |
| 13 | NONE | 0 | INCORRECT SIZE | ○ | ○ | ○ | 12 | 5 |
| 14 | PRINTING SURFACE SPECIFICATION | 1 | INCORRECT TYPE | — | ○ | ○ | 7 | 4 |
| 15 | PRINTING SURFACE SPECIFICATION | 1 | INCORRECT SIZE | — | ○ | ○ | 12 | 5 |
| 16 | PRINTING SURFACE SPECIFICATION | 1 | OUT OF PAPER | — | — | ○ | 5 | 3 |

FIG.43

210r

| | DEVICE CAPACITY ERRORS | | DEVICE STATUS ERRORS | | | | | |
|---|---|---|---|---|---|---|---|---|
| NO. | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 12 | NONE | 0 | INCORRECT TYPE | ○ | ○ | ○ | 7 | 4 |
| 13 | NONE | 0 | INCORRECT SIZE | ○ | ○ | ○ | 12 | 5 |
| 16 | PRINTING SURFACE SPECIFICATION | 1 | OUT OF PAPER | — | — | ○ | 5 | 3 |
| 1 | BINDING SPECIFICATION | 1 | INCORRECT TYPE | ○ | — | ○ | 7 | 4 |
| 2 | BINDING SPECIFICATION | 1 | INCORRECT TYPE | ○ | — | ○ | 7 | 4 |
| 14 | PRINTING SURFACE SPECIFICATION | 1 | INCORRECT TYPE | — | ○ | ○ | 7 | 4 |
| 3 | BINDING SPECIFICATION | 1 | INCORRECT SIZE | ○ | — | ○ | 12 | 5 |
| 4 | BINDING SPECIFICATION | 1 | INCORRECT SIZE | ○ | — | ○ | 12 | 5 |
| 15 | PRINTING SURFACE SPECIFICATION | 1 | INCORRECT SIZE | — | ○ | ○ | 12 | 5 |
| 11 | PRINTING SURFACE SPECIFICATION, BINDING SPECIFICATION | 2 | ○ | — | — | ○ | — | 0 |
| 9 | PRINTING SURFACE SPECIFICATION, BINDING SPECIFICATION | 2 | OUT OF PAPER | — | — | ○ | 15 | 3 |
| 10 | PRINTING SURFACE SPECIFICATION, BINDING SPECIFICATION | 2 | OUT OF PAPER | — | — | ○ | 5 | 3 |
| 5 | PRINTING SURFACE SPECIFICATION, BINDING SPECIFICATION | 2 | INCORRECT TYPE | — | — | ○ | 7 | 4 |
| 6 | PRINTING SURFACE SPECIFICATION, BINDING SPECIFICATION | 2 | INCORRECT TYPE | — | — | ○ | 7 | 4 |
| 7 | PRINTING SURFACE SPECIFICATION, BINDING SPECIFICATION | 2 | INCORRECT SIZE | — | — | ○ | 12 | 5 |
| 8 | PRINTING SURFACE SPECIFICATION, BINDING SPECIFICATION | 2 | INCORRECT SIZE | — | — | ○ | 12 | 5 |

FIG.44

210s

| | DEVICE CAPACITY ERRORS | | DEVICE STATUS ERRORS | | | | | |
|---|---|---|---|---|---|---|---|---|
| NO. | UNMET PRINTING CONDITIONS | NUMBER OF UNMET PRINTING CONDITIONS | PAPER SUPPLY ERROR | DUPLEX UNIT ERROR | STAPLE ERROR | DISCHARGE ERROR | ERROR NUMBER | TOTAL NUMBER OF STEPS |
| 12 | NONE | 0 | INCORRECT TYPE | ○ | ○ | ○ | 7 | 4 |
| 13 | NONE | 0 | INCORRECT SIZE | ○ | ○ | ○ | 12 | 5 |
| 16 | PRINTING SURFACE SPECIFICATION | 1 | OUT OF PAPER | — | — | ○ | 5 | 3 |
| 11 | PRINTING SURFACE SPECIFICATION, BINDING SPECIFICATION | 2 | ○ | — | — | ○ | — | 0 |

FIG.45

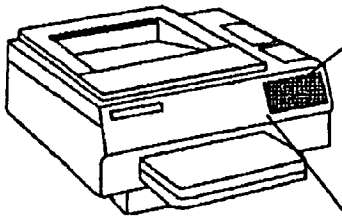

ERROR

RESOLUTION METHOD 1: PLEASE REPLACE THE SHEET IN THE FIRST SHEET SUPPLY TRAY WITH NORMAL SHEET
CAUSE: INCORRECT SHEET TYPE IN THE SHEET SUPPLY TRAY
PATH: FIRST SHEET SUPPLY TRAY → DUPLEX UNIT → STAPLER → SECOND DISCHARGE TRAY
NUMBER OF STEPS: 4

RESOLUTION METHOD 2: PLEASE REPLACE THE SHEET IN THE SECOND SHEET SUPPLY TRAY WITH B5-SIZE SHEET
CAUSE: INCORRECT SHEET SIZE IN THE SHEET SUPPLY TRAY
PATH: SECOND SHEET SUPPLY TRAY → DUPLEX UNIT → STAPLER → SECOND DISCHARGE TRAY
NUMBER OF STEPS: 5

RESOLUTION METHOD 3: PLEASE LOAD SHEET INTO THE THIRD SHEET SUPPLY TRAY
CAUSE: SHEET SUPPLY TRAY IS OUT OF SHEET
RESTRICTION: DUPLEX PRINTING IS UNAVAILABLE
PATH: THIRD SHEET SUPPLY TRAY → STAPLER → SECOND DISCHARGE TRAY
NUMBER OF STEPS: 3

RESOLUTION METHOD 4: PLEASE PRESS THE GO KEY
CAUSE: THE DEVICE IS TROUBLE-FREE
RESTRICTION: DUPLEX PRINTING IS UNAVAILABLE AND BINDING IS UNAVAILABLE
PATH: FOURTH SHEET SUPPLY TRAY → FIRST DISCHARGE TRAY
NUMBER OF STEPS: 0

IMAGE FORMING DEVICE PROVIDING USER WITH METHOD FOR CLEARING ERRORS

BACKGROUND OF THE INVENTION

1. Field of the Invention

The present invention relates to an image forming device capable of providing a user of a method to clear errors.

2. Related Art

Conventionally, when a printing device cannot perform printings under printing conditions specified by a user, the printing device stops printing operations and notifies the user of errors by using a display panel or the like. Japanese Patent Application-Publication No. SHO-63-217370 proposes to notify a user of, in addition to occurrence of errors, a method to clear the errors.

However, the conventional printing device cannot always provide an optimal method to the user. For example, even when there is more than one method to clear an error, the user is informed of only one method, which may not be the optimal one, but may be a complicated or time-consuming one. Also, when two or more errors occur at the same time, the user is notified of only one of the errors at a time. In this case, the user will be notified of another error after having clear one or more errors.

SUMMARY OF THE INVENTION

In the view of foregoing, it is an object of the present invention to overcome the above problems, and also to provide a transport device and a printing device including the transport device that is capable of informing a user of appropriate method to solve errors.

In order to attain the above and other objects, the present invention provides a processing medium conveying device including a plurality of processing units, a specifying unit that specifies at least one of processing conditions including processing paths and characteristics of a processing medium, each processing path being defined by a combination of two or more of the processing units, a status detecting unit that detects status of each processing unit, a determining unit that determines based on the detected status whether a process according to the specified processing condition is performable, a selecting unit that selects a plurality of the processing paths based both on the detected status and on the specified processing condition when the determining unit determines that the process is not performable, an error detecting unit that detects all errors that will occur on the selected processing paths, a memory that stores resolution methods for clearing errors, a displaying unit, and a controller that reads resolution methods for clearing the detected errors from the memory and displays at least one of the resolution methods read from the memory on the displaying unit as a comprehensive resolution method.

Characteristics of the processing medium include, for example, width, length, thickness, material, mass, stiffness, melting temperature, color, degree of transparency or reflection, flatness, abrasion coefficient.

There is also provided a processing medium conveying device including a plurality of processing units, a specifying unit that specifies at least one of processing conditions including processing paths and characteristics of a processing medium, each processing path being defined by a combination of two or more of the processing units, a status detecting unit that detects status of each processing unit, a determining unit that determines based on the detected status whether a process according to the specified processing condition is performable, a selecting unit that selects a plurality of the processing paths based both on the detected status and on the specified processing condition when the determining unit determines that the process is not performable, an error detecting unit that detects an error that will occur on the processing paths, the error detecting unit detecting at least one error on each of the selected processing paths, a first memory that stores resolution methods for clearing errors, a displaying unit, and a controller that reads, from the first memory, a plurality of resolution methods each for a corresponding one of the detected errors and displays a plurality of comprehensive resolution methods on the displaying unit based on the read resolution methods.

There is also provided an image forming device including a processing medium conveying device. The processing medium conveying device includes a plurality of processing units, a specifying unit that specifies at least one of processing conditions including processing paths and characteristics of a processing medium, each processing path being defined by a combination of two or more of the processing units, a status detecting unit that detects status of each processing unit, a determining unit that determines based on the detected status whether a process according to the specified processing condition is performable, a selecting unit that selects a plurality of the processing paths based both on the detected status and on the specified processing condition when the determining unit determines that the process is net performable, an error detecting unit that detects all errors that will occur on the selected processing paths, a memory that stores resolution methods for clearing errors, a displaying unit, and a controller that reads resolution methods for clearing the detected errors from the memory and displays at least one of the resolution methods read from the memory on the displaying unit as a comprehensive resolution method. The processing units include a printing unit that prints images on a processing medium, a supplying unit that supplies the processing medium to the printing unit, and a discharging unit onto which the processing medium is discharged after the processing medium has been printed in the printing unit.

There is also provided an image forming device including a processing medium conveying device. The processing medium conveying device includes a plurality of processing units, a specifying unit that specifies at least one of processing conditions including processing paths and characteristics of a processing medium, each processing path being defined by a combination of two or more of the processing units, a status detecting unit that detects status of each processing unit, a determining unit that determines based on the detected status whether a process according to the specified processing condition is performable, a selecting unit that selects a plurality of the processing paths based both on the detected status and on the specified processing condition when the determining unit determines that the process is not performable, an error detecting unit that detects an error that will occur on the processing paths, the error detecting unit detecting at least one error on each of the selected processing paths, a first memory that stores resolution methods for clearing errors, a displaying unit, and a controller that reads, from the first memory, a plurality of resolution methods each for a corresponding one of the detected errors and displays a plurality of comprehensive resolution methods on the displaying unit based on the read resolution methods. The processing units include a printing unit that prints images on a processing medium, a supplying unit that supplies the processing medium to the printing unit, and a discharging unit onto which the processing medium is discharged after the processing medium has been printed in the printing unit.

BRIEF DESCRIPTION OF THE DRAWINGS

In the drawings:

FIG. 6 is an explanatory diagram showing a sheet size restrictions table;

FIG. 7 is an explanatory diagram showing a sheet type restrictions table;

FIG. 8 is an explanatory diagram showing a conveying path restrictions table;

FIG. 9 is an explanatory diagram showing a steps table rating user effort required for each resolution method;

FIG. 10(*a*) is an explanatory diagram showing an example of a user-defined printing conditions table;

FIG. 10(*b*) is an explanatory diagram showing another example of the user-defined printing conditions table;

FIG. 11 is an explanatory diagram showing a sheet supply tray status table;

FIG. 12 is an explanatory diagram showing a discharge tray status table;

FIG. 13 is an explanatory diagram showing a cover open/close status table;

FIG. 14 is an explanatory diagram showing a staple status table;

FIG. 15 is an explanatory diagram showing a conveying path table;

FIG. 16 is an explanatory diagram showing a conveying path table;

FIG. 21 is an explanatory diagram showing an error table;

FIG. 22 is an explanatory diagram showing an error table;

FIG. 23 is an explanatory diagram of an error table;

FIG. 25 is an explanatory diagram of the error table;

FIG. 26 is an explanatory diagram of the error table;

FIG. 27 is an explanatory diagram of the error table;

FIG. 29 is an explanatory diagram of the error table;

FIG. 30 is an explanatory diagram of the error table;

FIG. 31 is an explanatory diagram of the error table;

FIG. 32 is an explanatory diagram of an example error display on the display unit;

FIG. 33 is an explanatory diagram of the error table;

FIG. 34 is an explanatory diagram of the error table;

FIG. 35 is an explanatory diagram of the error table;

FIG. 39 is an explanatory diagram of the error table;

FIG. 40 is an explanatory diagram of the error table;

FIG. 41 is an explanatory diagram of an example error display on the display unit;

FIG. 42 is an explanatory diagram of the error table;

FIG. 43 is an explanatory diagram of the error table;

FIG. 44 is an explanatory diagram of the error table; and

FIG. 45 is an explanatory diagram of an example error display on the display unit;

PREFERRED EMBODIMENT OF THE PRESENT INVENTION

Next, a laser printer 1 according to an embodiment of the present invention will be described.

Figure 1:
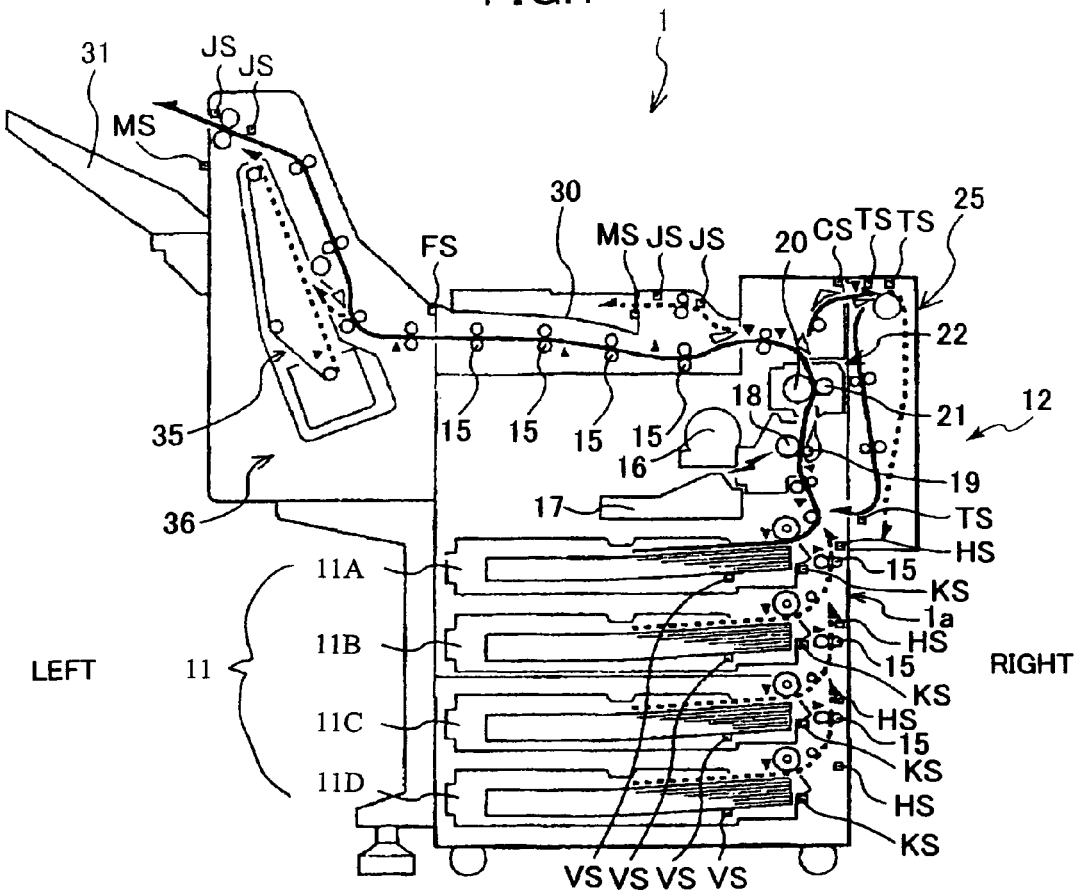
FIG. 1 is an explanatory diagram showing the general structure of a laser printer according to an embodiment of the present invention.

As shown in FIG. 1, the laser printer 1 includes a main casing 1*a*, a first discharge tray 30, a duplex printing unit 25, a finishing device 36, and a second discharge tray 31. The first discharge tray 30 is disposed on an upper part of the main casing 1*a*. The duplex printing unit 25 is disposed on a right side surface of the main casing 1*a*. The duplex printing unit 25 is used when executing duplex printing on a recording sheet and selectively opened and closed. The finishing device 36 is detachably mounted on a left side surface of the main casing 1*a* and includes a stapler 35 for bounding recorded sheets with a staple. The second discharge tray 31 is disposed on a left side surface of the finishing device 36.

The main casing 1*a* includes four sheet supply trays 11, a plurality of feed rollers 15, and a printing section 12. The sheet supply trays 11 include first to fourth sheet supply trays 11A–11D. The feed rollers 15 are for transporting recording sheets. The printing section 12 is for printing images on the recording sheets and includes a toner cartridge 16, a scanning unit 17, a photosensitive drum 18, a transfer roller 19, and a fixing unit 22. The scanning unit 17 scans a laser light across the photosensitive drum 18 having uniformly charged by a charging device, such as a charging roller (not shown). The transfer roller 19 is disposed in confrontation with the photosensitive drum 18 for transferring toner images onto a recording sheet. The fixing unit 22 includes a heat roller 20 and a pressing roller 21.

Each of the sheet supply trays 11 mounts recording sheets thereon and is provided with a sensor VS for detecting the type, such as the size and the material, and the amount of recording sheets mounted on the corresponding sheet supply tray 11. Sensors KS are provided to the main casing 1*a* at positions where the sheet supply trays 11 are mounted for detecting whether or not the sheet supply trays 11 are mounted on the main casing 1*a*.

Sensors HS are disposed near the feed rollers 15 for detecting whether paper jam has occurred and whether recording sheet has been transported thereby, and sensors TS are disposed near a supply part and a discharge part of the duplex printing unit 25 for detecting whether paper jam has occurred and whether recording sheet has passed thereby. A sensor CS is provided for detecting whether the duplex printing unit 25 is open.

Recording sheets supplied from the sheet supply trays 11 are discharged onto the first discharge tray 30 or the second discharge tray 31. Sensors JS are disposed in upstream side of the first discharge tray 30 and the second discharge tray 31 for detecting whether paper jam has occurred and whether a recording sheet has passed thereby. Sensors MS are provided to the first and second discharge trays 30, 31 for detecting whether the corresponding discharge trays 30, 31 are full of discharged recording sheets. A sensor FS is provided to the left side surface of the main casing 1*a* at a position where the finishing device 36 is mounted for detecting whether the finishing device 36 is being mounted.

Figure 2:
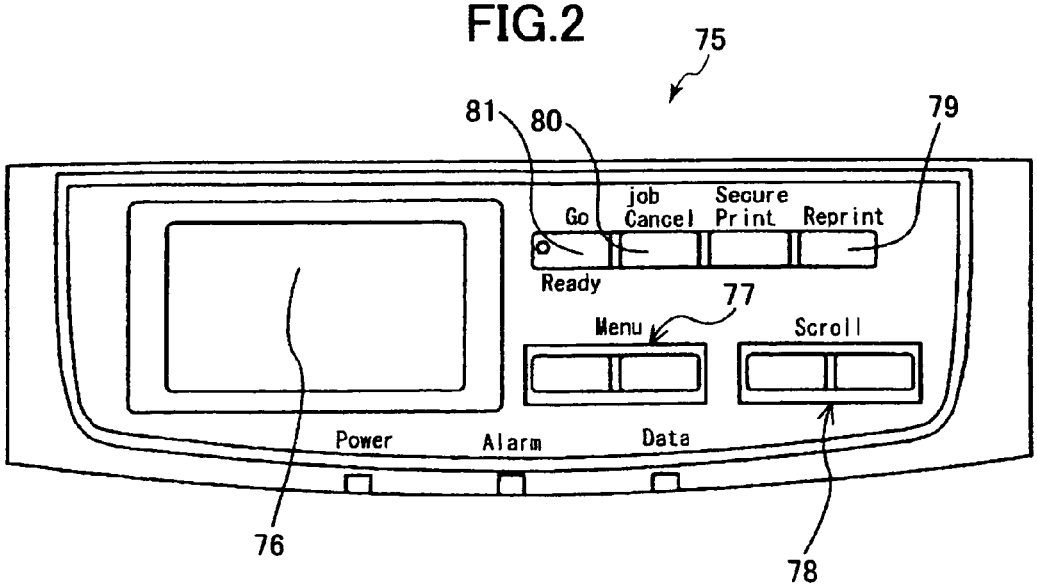
FIG. 2 is a plan view showing a control panel on the laser printer.

An operating panel 75 shown in FIG. 2 is disposed on the upper surface of the main casing 1*a*. The operating panel 75 includes a rectangular display panel 76 and various buttons disposed right to the display panel 76. The display panel 76 displays operation conditions of the laser printer 1 and the like. The buttons include a menu button 77, a scroll button 78, a reprint button 79, a print stop button 80, and a GO button 81. Using the menu button 77, a user can make various selections, such as the type of recording sheet to use and whether or not to perform duplex printing. The user can scroll up and down on the display panel 76 by the scroll button 78. Printing is executed when the GO button 81 is pressed down in a manner described later. The user makes various settings described later.

Figure 3:
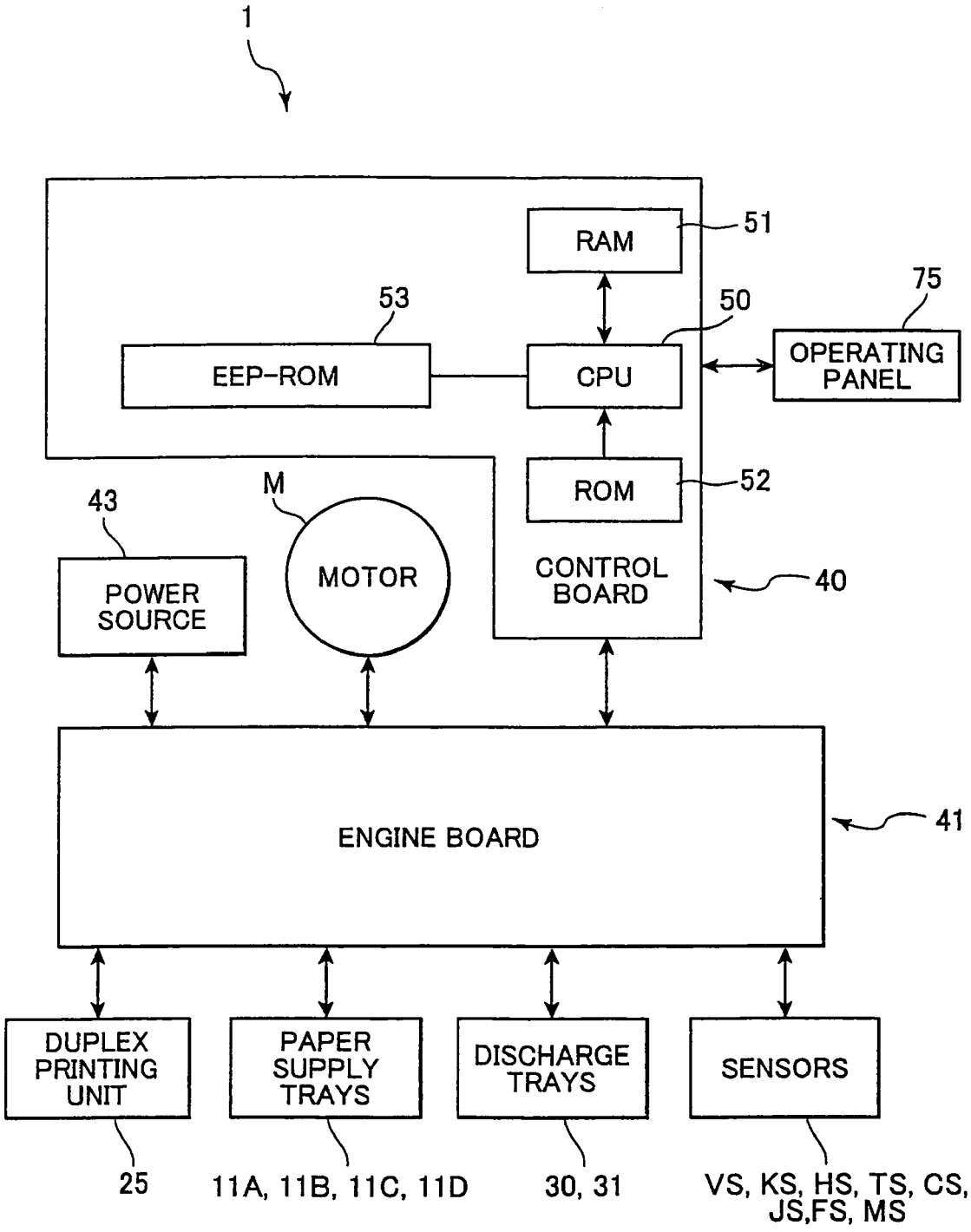
FIG. 3 is a block diagram showing the electrical configuration of the laser printer.

Next, an electrical configuration of the laser printer 1 will be described with reference to FIG. 3. As shown in FIG. 3, the laser printer 1 includes the operating panel 75, a control board 40, and an engine board 41. The operating panel 75 is connected to the control board 40, which is connected to the engine board 41. The control board 40 includes a central processing unit (CPU) 50, a random access memory (RAM) 51, a read only memory (ROM) 52, and an Electronically Erasable and Programmable Read Only Memory (EEP-ROM) 53. The CPU 50 is for controlling overall operation of the laser printer 1. The RAM 51 is for temporarily storing such data as data input from the operating panel 75 through operations by the user. The ROM 52 stores control programs and the like that the CPU 50 executes. The EEP-ROM 53 stores programs and various tables.

Connected to the engine board 41 are a power source 43, a motor M, the sheet supply trays 11, the first and second discharge trays 30, and above-mentioned various sensors VS, KS, HS, TS, CS, JS, FS, and MS. The motor M is for driving the feed rollers 15 that transport recording sheets and a supply roller and a discharge roller now shown.

In the laser printer 1, the user operates operating panel 75 to specify desired printing conditions. For example, the user specifies the size and type of recording sheet to use, one of the sheet supply trays 11 from which to feed recording sheets, and one of the discharge trays 30, 31 onto which recording sheets are discharged. In accordance with the specified printing conditions, the feed rollers 15 supplies a recording sheet from a specified one of the sheet supply trays 11 to the printing section 12, where the printing is performed on the recording sheet, and then the printed sheet is discharged onto a specified one of the discharge trays 30, 31.

The sensors VS, KS, HS, TS, CS, JS, FS, MS detect conditions of the sheet supply trays 11, the discharge trays 30, 31, the duplex printing unit 25, and the finishing device 36. Based on the detection results, the CPU 50 determines whether or not the printing is possible while meeting all the printing conditions specified by the user.

Figure 4:
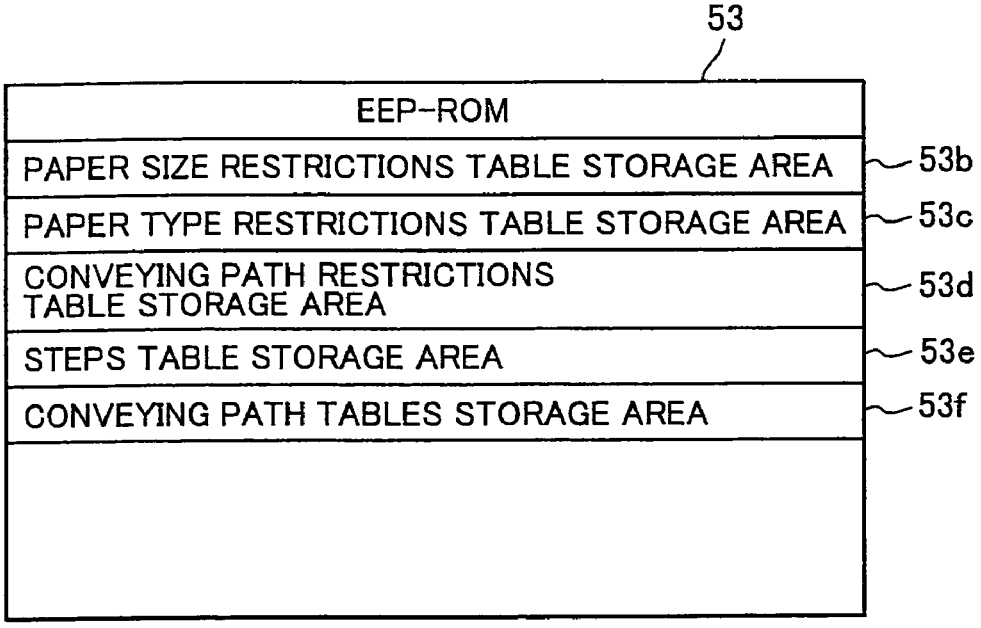
FIG. 4 is an explanatory diagram showing storage areas in an EEP-ROM in the laser printer.

Next, a storage area of the EEP-ROM 53 will be described with reference to FIG. 4. As shown in FIG. 4, the EEP-ROM 53 includes a sheet size restrictions table storage area 53*b*, a sheet type restrictions table storage area 53*c*, a conveying path restrictions table storage area 53*d*, a steps table storage area 53*e*, and a conveying path tables storage area 53*f*.

The sheet size restrictions table storage area 53*b* stores a sheet size restrictions table 100 that stores restrictions on sizes of recording sheets that the laser printer 1 can use. An example of the sheet size restrictions table 100 is shown in FIG. 6. The sheet size restrictions table 100 of FIG. 6 indicates whether the sheet supply trays 11, the duplex printing unit 25, the first discharge tray 30, the second discharge tray 31, and the finishing device 36 can be used for each of A3-size sheets, B4-size sheets, legal-size sheets, A4-size sheets, letter-size sheets, and B5-size sheets.

More specifically, in the example of FIG. 6, all the sheet supply trays 11 and the first discharge tray 30 can be used for the A3-size sheets. However, the second discharge tray 31 cannot be used for the A3-size sheets, and the finishing device 36 cannot staple the A3-size sheets. All the sheet supply trays 11 and the first discharge tray 30 can be used for B4-size, legal-size, and B5-size sheets, but the second discharge tray 31 cannot. The finishing device 36 can staple the B4-size, legal-size, and B5-size sheets. All the sheet supply trays 11, the first discharge tray 30, and the second discharge tray 31 can be used for the A4-size and letter-size sheets. The finishing device 36 can staple the A4-size and letter-size sheets. The duplex printing unit 25 can be used for recording sheets of any size. That is, duplex printing is possible regardless of the size of recording sheets to use.

The sheet type restrictions table storage area 53*c* stores a sheet type restrictions table 110 that stores restrictions on the types of recording sheets that the laser printer 1 can use. An example of the sheet type restrictions table 110 is shown in FIG. 7. The sheet type restrictions table 110 of FIG. 7 stores whether or not the sheet supply trays 11, the duplex printing unit 25, the first discharge tray 30, the sheet supply trays 11, the duplex printing unit 25, and the finishing device 36 can be used for normal sheets, thick sheets, and transparent sheets.

More specifically, all the sheet supply trays 11, the duplex printing unit 25, the first discharge tray 30, the second discharge tray 31, and the finishing device 36 can be used for the normal sheets. The first sheet supply tray 11A, the second sheet supply tray 11B, the duplex printing unit 25, the first discharge tray 30 can be used for the thick sheets. The finishing device 36 cannot be used for stapling the thick sheets. The first sheet supply tray 11A and the first discharge tray 30 can be used for the transparent sheets. The finishing device 36 cannot be used for stapling the transparent sheets.

The conveying path restrictions table storage area 53*d* stores a conveying path restrictions table 120, an example of which is shown in FIG. 8. The conveying path restrictions table 120 stores whether or not recording sheets supplied from each of the sheet supply trays 11, the duplex printing unit 25, and the stapler 35 of the finishing device 36 can be transported to the first discharge tray 30, the second discharge tray 31, the duplex printing unit 25, and the stapler 35.

In the example of FIG. 8, recording sheets supplied from any of the first sheet supply tray 11A, the second sheet supply tray 11B, the third sheet supply tray 11C can be transported to any of the duplex printing unit 25, the first discharge tray 30, the second discharge tray 31, and the stapler 35. Recording sheets supplied from the fourth sheet supply tray 11D can only be transported to the first discharge tray 30, but cannot be transported to any of the duplex printing unit 25, the second discharge tray 31, and the stapler 35. Recording sheets discharged from the duplex printing unit 25 can be transported to any of the first discharge tray 30, the second discharge tray 31, and the stapler 35, but cannot be transported back to the duplex printing unit 25.

Recording sheets discharged from the stapler 35 can only be transported to the second discharge tray 31.

The steps table storage area 53*e* stores a steps table 130, an example of which is shown in FIG. 9. The steps table 130 stores error numbers, error causes, resolution methods for errors, and numbers of steps to clear the errors. The number of steps indicates how many steps the user needs to take to clear an error. For example, the error No. 1 occurs when the first discharge tray 30 is full of discharged sheets. In this case, the user can remove the discharged sheets from the first discharge tray 30 to clear this error. Accordingly, the number of steps for the error No. 1 is 1. Similarly, the number of steps for the error No. 2 is 1. The error No. 3 occurs when the first sheet supply tray 11A is out of sheet. In order to clear the error No. 3, the user needs to ① pull out the first sheet supply tray 11A, ② load recording sheets in the first sheet supply tray 11A, and ③ close the first sheet supply tray 11A. Therefore, the number of steps is 3. The number of steps for each of the error Nos. 4, 5, and 6 is also 3.

The error 7 occurs when an incorrect type of recording sheets with a correct size are loaded in the first sheet supply tray 11A. In order to clear this error, the user needs to ① pull out the first sheet supply tray 11A, ② remove currently loaded recording sheets from the first sheet supply tray 11A, ③ load a correct type of recording sheets into the first sheet supply tray 11A, and ④ close the first sheet supply tray 11A. The number of steps for the error No. 7 is 4. This is also true for the error Nos. 8, 9, and 10. The error No. 11 occurs when recording sheets loaded in the first sheet supply tray 11A have an incorrect size. In order to clear this error, the user ① pulls out the first sheet supply tray 11A, ② removes the currently loaded recording sheets, ③ adjust a position of a guide member (not shown) so that recording sheets with the correct size can be loaded in the first sheet supply tray 11A, ④ loads the recording sheets with the correct size in the first sheet supply tray 11A, and ⑤ closes the first sheet supply tray 11A. Therefore, the number of steps for the error No. 11 is 5. The same is true for the error Nos. 12, 13, and 14. The error No. 15 occurs when the duplex printing unit 25 is open. The error No. 16 occurs when the stapler 35 is out of staples and can be cleared by loading staples. Although detailed description is omitted, the number of steps for the error No. 16 is 6.

It should be noted that the above-described resolution methods for errors and the numbers of steps stored in the steps table 130 are default methods and numbers and that these methods and numbers could be changed as desired. For example, when the number of steps for clearing a certain error is 6, those who are experts (manager, for example) could clear the error by taking the six steps, but those who are not may be faced with difficulties. In this case, it would be desirable to change the resolution method to "call manager" and the number of steps to "1". The resolution method and the number of steps could be changed through operation on the operating panel 75 or a personal computer connected to the laser printer 1.

The conveying path table storage area 53*f* stores conveying path tables 190 and 200, examples of which are shown in FIGS. 15 and 16, respectively. The conveying path table 190 stores lists of conveying paths, which are combinations of two or more of the sheet supply trays 11, the duplex printing unit 25, the stapler 35, the first discharge tray 30, the second discharge tray 31. In this example, there are 16 conveying paths numbered from 1 to 16.

The conveying path table 200 stores a list of conveying paths that are available when the finishing device 36 is removed from the laser printer 1, i.e., when the finishing device 36 is not used. In this embodiment, the conveying path Nos. 1, 3, 5, 7, 9, and 11 are available.

Figure 5:
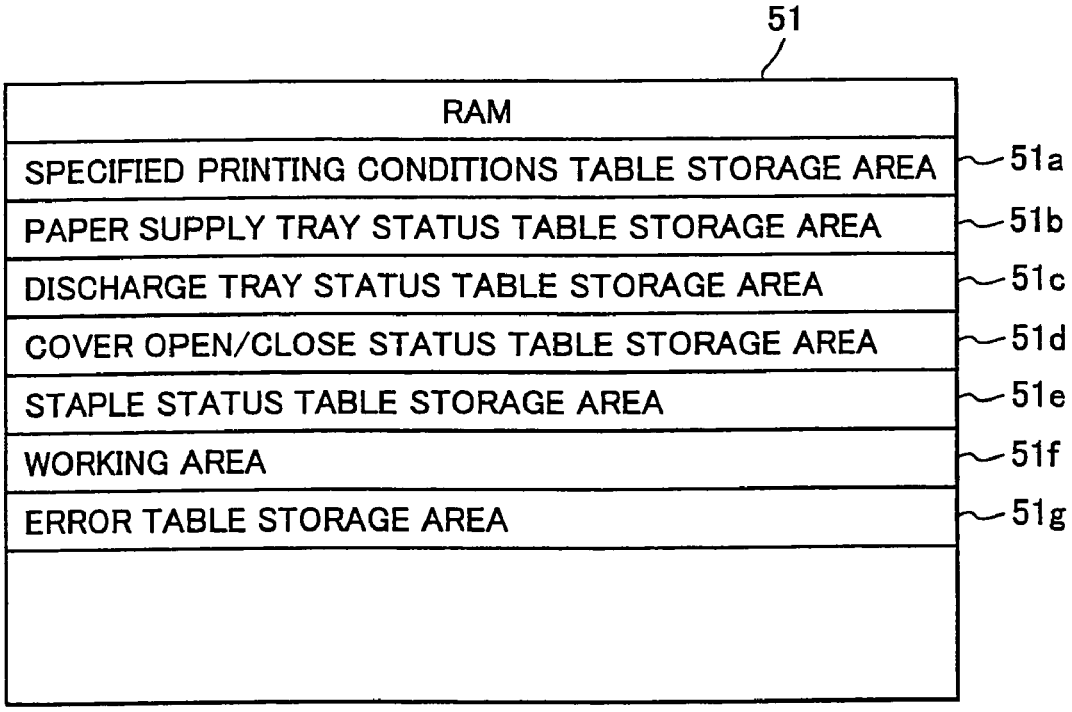
FIG. 5 is an explanatory diagram showing storage areas in a RAM in the laser printer.

Next, a storage area of the RAM 51 will be described with reference to FIG. 5. As shown in FIG. 5, the RAM 51 includes a specified printing conditions table storage area 51*a*, a sheet supply tray status table storage area 51*b*, a discharge tray status table storage area 51*c*, a cover open/close status table storage area 51*d*, a staple status table storage area 51*e*, a working area 51*f*, and an error table storage area 51*g*.

The specified printing conditions table storage area 51*a* stores a specified printing conditions table 140, an example of which is shown in FIG. 10(*a*). The specified printing conditions table 140 stores printing conditions specified by the user through operation on the operating panel 75. In the example of FIG. 10(*a*), none of the sheet supply trays 11 is specified, and the size of recording sheets to use is B5. The type of recording sheets to use is normal, and printing is performed only on one side of the recording sheets. The stapler 35 is not used. None of the discharge trays 30, 31 is specified.

The sheet supply tray status table storage area 51*b* stores a sheet supply tray status table 150, an example of which is shown in FIG. 11. The sheet supply tray status table 150 is for storing a current condition of each sheet supply trays 11 and is updated by the CPU 50 based on detection results of the sensors VS at every interrupting timing. In the example of FIG. 11, the first sheet supply tray 11A is for transparent B5-size sheets, and such recording sheets are currently loaded in the first sheet supply tray 11A. Also, the second sheet supply tray 11B is for normal A4-size sheets, and such recording sheets are currently loaded in the second sheet supply tray 11B. The third sheet supply tray 11C is for normal B5-size sheet, and the third sheet supply tray 11C is currently out of recording sheets. The fourth sheet supply tray 11D is for normal B5-size sheets and currently loaded with such recording sheets.

The discharge tray status table storage area 51*c* stores a discharge tray status table 160, an example of which is shown in FIG. 12. The discharge tray status table 160 is for storing current conditions of each of the first and second discharge trays 30, 31 and updated by the CPU 50 based on the detection results of the sensors MS at every predetermined interrupting timing. In the example of FIG. 12, the first discharge tray 30 is currently full of recording sheets, and the second discharge tray 31 currently has some space.

The cover open/close status table storage area 51*d* is for storing a cover open/close status table 170, an example of which is shown in FIG. 13. The cover open/close status table 170 is for storing as to whether the duplex printing unit 25 is currently open or closed and is updated by the CPU 50 based on the detection results of the sensor CS at predetermined interrupting timing. The cover open/close status table 170 shown in FIG. 13 indicates that the duplex printing unit 25 is currently closed.

The staple status table storage area 51*e* stores a staple status table 180, an example of which is shown in FIG. 14. The staple status table 180 is for storing as to whether staples are currently loaded in the stapler 35 or the stapler 35 is out of staples. The staple status table 180 is updated by the CPU 50 based on the detection results of a sensor (not shown) at predetermined interruption timing. In the example of FIG. 14, it is indicated that the stapler 35 is currently loaded with staples.

The working area 51*f* temporarily stores various data. The error table storage area 51*g* stores an error table 210, an example of which is shown in FIG. 21.

Here, printing conditions can be broadly classified as those related to the device's capacity and those related to the device's status. Errors generated by the laser printer 1 can be broadly classified as those related to the device's capacity, and those related to the device's status. Errors related to the device's capacity include a printing surface specification error and a binding specification error, for example. Errors related to the device's status include a feed error, a duplex unit error, a stapling error, and a discharge error, for example. The feed error includes a sheet size error, a sheet type error, and a sheet empty error.

The error table 210 stores printing conditions specified by the user which cannot be met due to the device's capacity, a number of printing conditions which cannot be met due to the device's capacity, errors which would occur in relation to the device's status, number of the errors, and the total number of steps, in relation to one or more of the conveying path Nos. 1 to 16.

Figure 17:
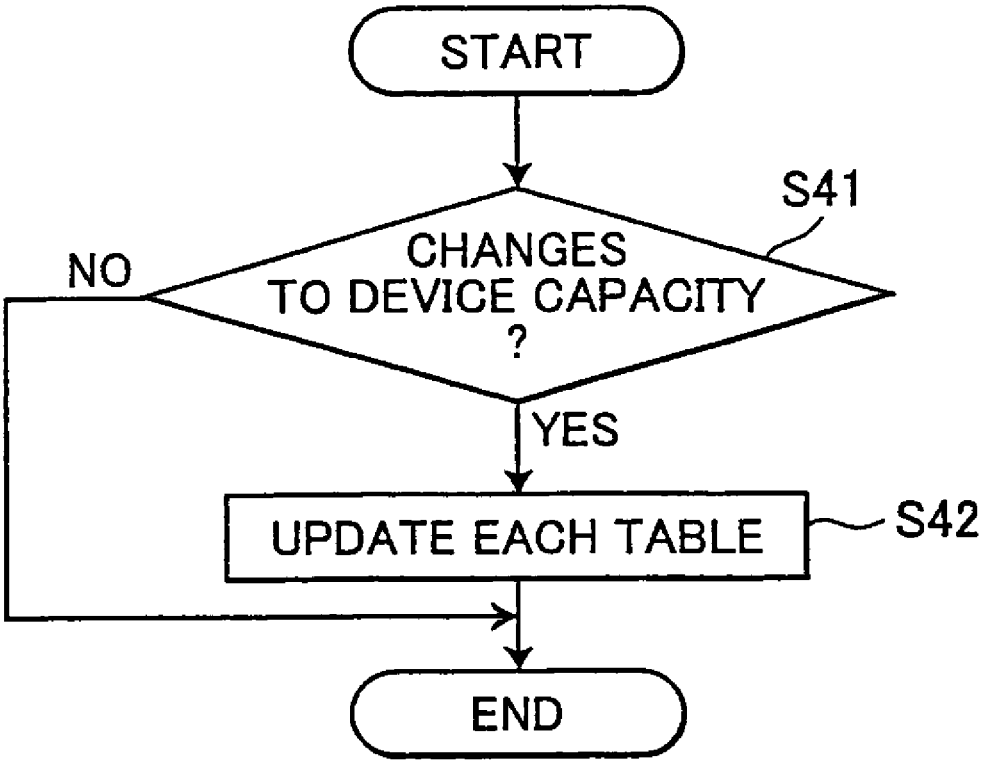
FIG. 17 is a flowchart showing a device capacity updating process executed by the laser printer.

Next, a device capacity modifying process will be described with reference to the flowchart in FIG. 17. The device capacity modifying process is repeatedly executed by the CPU 50 at prescribed intervals. First in S41, the CPU 50 determines whether or not there have been any changes to the device's capacity. If the capacity has not changed (S41:NO), then the process ends. However, if the CPU 50 determines that the capacity has changed (S41:YES), then in S42, the CPU 50 updates each of the tables 100, 110, 120, 170, and 180 according to the changed device capacity, and ends the process. For example, when the finishing device 36 is removed from the laser printer 1, the CPU 50 determines in S41 that the capacity of the device has changed. Then, the CPU 50 removes the column "stapling possible" from the sheet size restrictions table 100 and the sheet type restrictions table 110 and removes the column "stapler 35" from the conveying path restrictions table 120.

Next, a print process of the laser printer 1 will be described with reference to the flowcharts in FIGS. 18 through 20.

Figure 18:
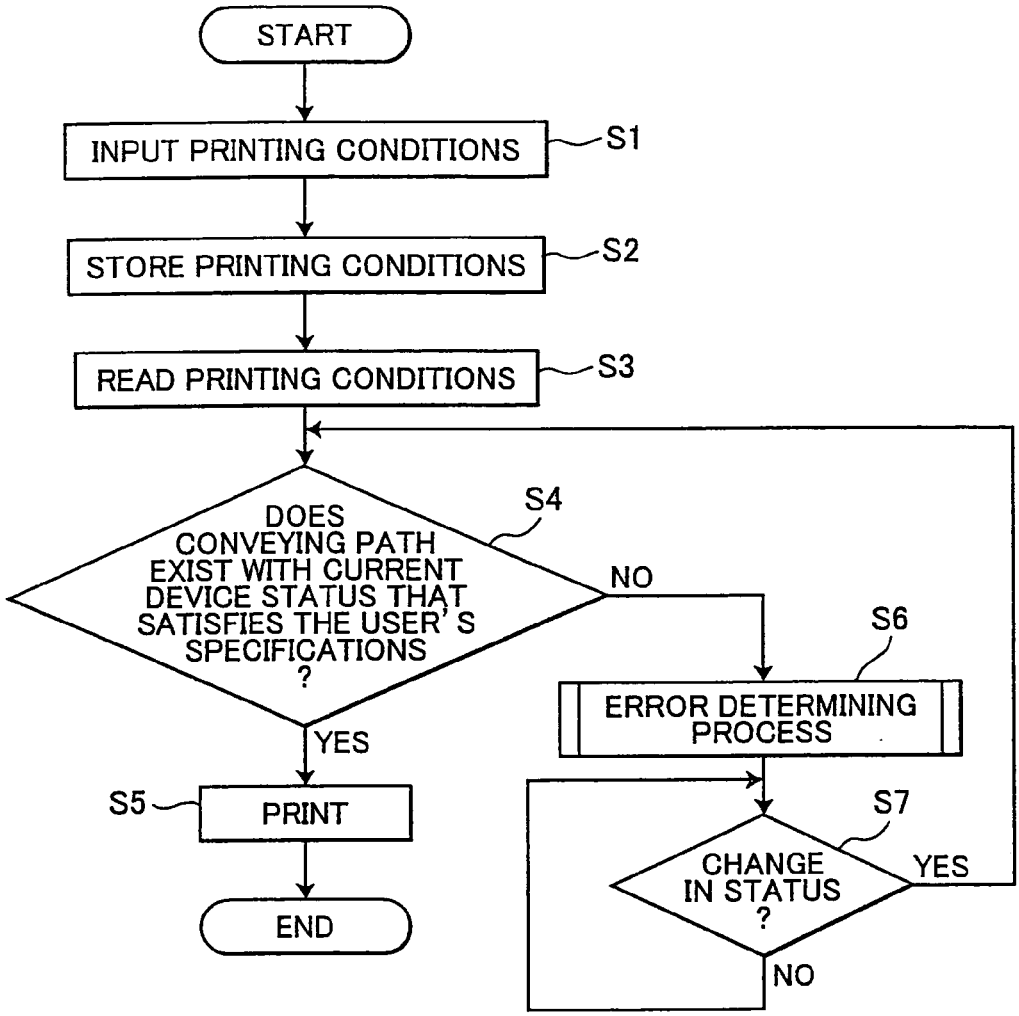
FIG. 18 is a flowchart showing a print process executed by the laser printer.

In FIG. 18, first the user operates the operating panel 75 in S1 to input printing conditions. In S2, the printing conditions are stored in the specified printing conditions table 140. For example, if the user requests a one-sided print on normal B5-size sheet without specifying the sheet supply tray 11 and the discharge tray 30, 31 and indicates that the printed material should not be bound by the stapler 35, then the printing conditions table 140 would be that shown in FIG. 10(*a*). Alternatively, if the user requests a duplex printing on normal B5-size sheet to be bound by the stapler 35, without specifying the sheet supply tray 11 and the discharge tray 30, 31, then the printing conditions table 140 would be that shown in FIG. 10(*b*).

In S3, the printing conditions are read from the printing conditions table 140, and in S4, it is determined whether or not it is possible to perform a printing operation satisfying all the printing conditions specified by the user with the current state of the laser printer 1. In other words, it is determined whether or not there is any conveying path currently satisfying the printing conditions. The CPU 50 performs this determination by referencing the sheet size restrictions table 100, the sheet type restrictions table 110, the conveying path restrictions table 120, the sheet supply tray status table 150, the discharge tray status table 160, the cover open/close status table 170, and the staple status table 180 shown in FIGS. 6–8 and 11–14, respectively. If the CPU 50 determines in S4 that printing is possible (S4:YES), then the printing process is performed in S5 and the current process ends. On the other hand, if the CPU 50 determines in S4 that printing is not possible (S4:NO), then an error determining process is executed in S6.

(Case 1)

The error determining process will be described with reference to the flowchart of FIG. 19. In this example, description will be provided for Case 1, where printing conditions are specified as shown in FIG. 10(*b*) (supply tray specification: none, size specification: B5, type specification: normal sheet, printing surface specification: both sides, binding specification: yes, discharge tray specification: none) and the finishing device 36 is being mounted. The number of ignorable printing conditions is "1", and the "printing surface specification" is set as an ignorable printing condition.

Here, the number of ignorable printing conditions is a number specified by the user indicating the number of user-specified printing conditions that could be ignored, and the ignorable printing condition is one ore more of user-specified printing conditions that can be ignored when the condition is not met in order to perform a printing operation.

In S11, a single conveying path is selected from the conveying path table 190 in FIG. 15. In this example, the conveying path No. 1 is selected. In the conveying path No. 1, sheet is supplied from the first sheet supply tray 11A; the duplex printing unit 25 is used; the stapler 35 is not used; and the sheet is discharged onto the first discharge tray 30. Next in S12, the CPU 50 determines whether or not all user-specified printing conditions related to the device's capacity, excluding the ignorable printing condition, are met for the conveying path No. 1. In the case of the conveying path No. 1, the stapler 35 cannot be used and so the "binding specification" printing condition is not met. Since the "binding specification" is not relative to the ignorable printing condition, which is "printing surface specification" in this example, the CPU 50 determines that not all printing conditions are met (S12:NO), and the process returns to S11. In S11, the CPU 50 selects the next conveying path No. 2.

In the conveying path No. 2, sheet is supplied from the first sheet supply tray 11A; the duplex printing unit 25 is used; the stapler 35 is not used; and the sheet is discharged onto the second discharge tray 31. In S12, the CPU 50 determines whether or not all printing conditions related to the device's capacity, excluding the ignorable printing condition, are met for the conveying path No. 2. In the case of the conveying path No. 2, the stapler 35 cannot be used and so the "binding specification" printing condition is not met. Since the "binding specification" is not relative to the ignorable printing condition, which is "printing surface specification" in this example, the CPU 50 determines that not all printing conditions are met (S12:NO), and the process returns to S11. In S11, the CPU 50 selects the next conveying path No. 3.

In the conveying path No. 3, sheet is supplied from the second sheet supply tray 11B; the duplex printing unit 25 is used; the stapler 35 is not used; and the sheet is discharged onto the first discharge tray 30. Next in S12, the CPU 50 determines whether or not all printing conditions related to the device's capacity, excluding the ignorable printing condition, are met for the conveying path No. 3. In the case of the conveying path No. 3, the stapler 35 cannot be used and so the "binding specification" printing condition is not met. Since the "binding specification" is not relative to the ignorable printing condition, which is "printing surface specification" in this example, the CPU 50 determines that not all printing conditions are met (S12:NO), and the process returns to S11. In S11, the CPU 50 selects the next conveying path No. 4.

In the conveying path No. 4, sheet is supplied from the second sheet supply tray 11B; the duplex printing unit 25 is used; the stapler 35 is not used; and the sheet is discharged onto the second discharge tray 31. Next in S12, the CPU 50 determines whether or not all printing conditions related to the device's capacity, excluding the ignorable printing condition, are met for the conveying path No. 4. In the case of the conveying path No. 4, the stapler 35 cannot be used and so the "binding specification" printing condition is not met. Since the "binding specification" is not relative to the ignorable printing condition, which is "printing surface specification" in this example, the CPU 50 determines that not all printing conditions are met (S12:NO), and the process returns to S11. In S11, the CPU 50 selects the next conveying path No. 5.

In the conveying path No. 5, sheet is supplied from the first sheet supply tray 11A; the duplex printing unit 25 is not used; the stapler 35 is not used; and the sheet is discharged onto the first discharge tray 30. Next in S12, the CPU 50 determines whether or not all printing conditions related to the device's capacity, excluding the ignorable printing condition, are met for the conveying path No. 5. In the case of the conveying path No. 5, the duplex printing unit 25 and the stapler 35 cannot be used, so that the printing conditions "printing surface specification" and "binding specification" are not met. Since the "binding specification" is not relative to the ignorable printing condition, which is "printing surface specification" in this example, the CPU 50 determines that not all printing conditions are met (S12:NO), and the process returns to S11. In S11, the CPU 50 selects the next conveying path No. 6.

In the conveying path No. 6, sheet is supplied from the first sheet supply tray 11A; the duplex printing unit 25 is not used; the stapler 35 is not used; and the sheet is discharged onto the second discharge tray 31. Next in S12, the CPU 50 determines whether or not all printing conditions related to the device's capacity, excluding the ignorable printing condition, are met for the conveying path No. 6. In the case of the conveying path No. 6, the duplex printing unit 25 and the stapler 35 cannot be used, so that the printing conditions "printing surface specification" and "binding specification" are not met. Since the "binding specification" is not relative to the ignorable printing condition, which is "printing surface specification" in this example, the CPU 50 determines that not all printing conditions are met (S12:NO), and the process returns to S11. In S11, the CPU 50 selects the next conveying path No. 7.

In the conveying path No. 7, sheet is supplied from the second sheet supply tray 11B; the duplex printing unit 25 is not used; the stapler 35 is not used; and the sheet is discharged onto the first discharge tray 30. Next in S12, the CPU 50 determines whether or not all printing conditions related to the device's capacity, excluding the ignorable printing condition, are met for the conveying path No. 7. In the case of the conveying path No. 7, the duplex printing unit 25 and the stapler 35 cannot be used, so that the printing conditions "printing surface specification" and "binding specification" are not satisfied. Since the "binding specification" is not relative to the ignorable printing condition, which is "printing surface specification" in this example, the CPU 50 determines that not all printing conditions are met (S12:NO), and the process returns to S11. In S11, the CPU 50 selects the next conveying path No. 8.

In the conveying path No. 8, sheet is supplied from the second sheet supply tray 11B; the duplex printing unit 25 is not used; the stapler 35 is not used; and the sheet is discharged onto the second discharge tray 31. Next in S12, the CPU 50 determines whether or not all printing conditions related to the device's capacity, excluding the ignorable printing condition, are met for the conveying path No. 8. In the case of the conveying path No. 8, the duplex printing unit 25 and the stapler 35 cannot be used, so that the printing conditions "printing surface specification" and "binding specification" are not satisfied. Since the "binding specification" is not relative to the ignorable printing condition, which is "printing surface specification" in this example, the CPU 50 determines that not all printing conditions are met (S12:NO), and the process returns to S11. In S11, the CPU 50 selects the next conveying path No. 9.

In the conveying path No. 9, sheet is supplied from the third sheet supply tray 11C; the duplex printing unit 25 is not used; the stapler 35 is not used; and the sheet is discharged onto the first discharge tray 30. Next in S12, the CPU 50 determines whether or not all printing conditions related to the device's capacity, excluding the ignorable printing condition, are met for the conveying path No. 9. In the case of the conveying path No. 9, the duplex printing unit 25 and the stapler 35 cannot be used, so that the printing conditions "printing surface specification" and "binding specification" are not met. Since the "binding specification" is not relative to the ignorable printing condition, which is "printing surface specification" in this example, the CPU 50 determines that not all printing conditions are met (S12:NO), and the process returns to S11. In S11, the CPU 50 selects the next conveying path No. 10.

In the conveying path No. 10, sheet is supplied from the third sheet supply tray 11C; the duplex printing unit 25 is not used; the stapler 35 is not used; and the sheet is discharged onto the second discharge tray 31. Next in S12, the CPU 50 determines whether or not all printing conditions related to the device's capacity, excluding the ignorable printing condition, are met for the conveying path No. 10. In the case of the conveying path No. 10, the duplex printing unit 25 and the stapler 35 cannot be used, so that the printing conditions "printing surface specification" and "binding specification" cannot be met. Since the "binding specification" is not relative to the ignorable printing condition, which is "printing surface specification" in this example, the CPU 50 determines that not all printing conditions are met (S12:NO), and the process returns to S11. In S11, the CPU 50 selects the next conveying path No. 11.

In the conveying path No. 11, sheet is supplied from the fourth sheet supply tray 11D; the duplex printing unit 25 is not used; the stapler 35 is not used; and the sheet is discharged onto the first discharge tray 30. Next in S12, the CPU 50 determines whether or not all printing conditions related to the device's capacity, excluding the ignorable printing condition, are met for the conveying path No. 11. In the case of the conveying path No. 11, the duplex printing unit 25 and the stapler 35 cannot be used, so that the printing conditions "printing surface specification" and "binding specification" cannot be met. Since the "binding specification" is not relative to the ignorable printing condition, which is "printing surface specification" in this example, the CPU 50 determines that not all printing conditions are met (S12:NO), and the process returns to S11. In S11, the CPU 50 selects the next conveying path No. 12.

In conveying path No. 12, sheet is supplied from the first sheet supply tray 11A; the duplex printing unit 25 is used; the stapler 35 is used; and the sheet is discharged onto the second discharge tray 31. Since the duplex printing unit 25 and the stapler 35 are both used on conveying path No. 12, the printing conditions "printing surface specification" and "binding specification" can be met. Hence, the CPU 50 determines in S12 that all printing conditions related to the device's capacity, excluding the ignorable printing condition, are met (S12:YES). Accordingly, the process proceeds to S13. In S13, the CPU 50 determines whether or not the number of conditions not met exceeds the number of ignorable printing conditions. Since there are "0" conditions not met in the case of the conveying path No. 12, and "0" does not exceed the number of ignorable printing conditions "1" (S13:NO), then in S14, the CPU 50 stores the conveying path number, which is "12" in this example, the unmet conditions, which is "none", and the number of unmet conditions, which is "0" in this example, in the error table 210 (see FIG. 25).

Next in S15, the CPU 50 determines errors related to the device's status for conveying path No. 12 and stores these errors and error numbers of these errors in the error table 210 in association with the conveying path No. 12. Specifically, sheet is supplied from the first sheet supply tray 11A in the case of conveying path No. 12, the size of sheet in the first sheet supply tray 11A is B5 according to the sheet supply status table 150 (FIG. 11). Therefore, the printing condition for sheet size is met. However, the type of sheet in the first sheet supply tray 11A is a transparency, which does not satisfy the sheet type printing condition of "normal sheet," causing the sheet type error. While the sheet is to be discharged onto the second discharge tray 31 in the case of conveying path No. 12, a discharge error does not occur because the second discharge tray 31 is not full according to the discharge tray status table 160 in FIG. 12. Also, a duplex unit error or a staple error will not occur since the status of the cover (duplex printing unit 25) is "closed" and the status of staples in the stapler 35 is "Yes" according to the cover open/close status table 170 and the staple status table 180, respectively. Hence, conveying path No. 12 produces only one error in which the sheet type of the first sheet supply tray 11A is incorrect.

Here, each paper supply tray 11 may produce one or more of the sheet size error, the sheet type error, and the sheet empty error, which are given higher priority in this order. That is, the sheet size error has a highest priority and the sheet empty error has a least priority. Then, if any of the paper supply trays 11 produces a plurality of these errors, then only one of the errors with the highest priority is determined in S15.

Then, the CPU 50 references the steps table 130 of FIG. 9 and reads the error number for the targeted errors that have been determined. Since the error number for an incorrect sheet type of the first sheet supply tray 11A is "7," the error number "7" is stored in the error table 210 (FIG. 25) in association with the conveying path No. 12.

Next in S16, the CPU 50 references the steps table 130 (FIG. 9), reads a number of steps required for clearing the targeted error, and stores the total number of steps in the error table 210 (FIG. 25) in association with conveying path No. 12. In this example, the number of steps for clearing error number "7" is 4. Since no other errors occur, the total number of steps is 4. In S17, the CPU 50 determines whether or not there is any other conveying path. Since other conveying path exists in the present example (S17:YES), the process returns to S11 where the next conveying path No. 13 is selected.

In conveying path No. 13, sheet is supplied from the second sheet supply tray 11B; the duplex printing unit 25 is used; the stapler 35 is used; and the sheet is discharged onto the second discharge tray 31. Since both the duplex printing unit 25 and the stapler 35 are used on conveying path No. 13, the printing conditions "printing surface specification" and "binding specification" are satisfied. Hence, a positive determination is made in S12 (S12:YES), and the process proceeds to S13. Since the number of unmet conditions is "0" in the case of conveying path No. 13, which does not exceed the number of ignorable printing conditions "1", a negative determination is made in S13 (S13:NO). Then in S14, the CPU 50 stores the conveying path number (13), the unmet conditions (none), and the number of unmet conditions (0) in the error table 210.

In S15, the CPU 50 determines the errors related to the device's status for conveying path No. 13 and stores these errors and error numbers of these errors into the error table 210 in association with the conveying path No. 13. Specifically, sheet is supplied from the second sheet supply tray 11B in the case of conveying path No. 13. Referencing the sheet supply tray status table 150 (FIG. 11), the sheet size in the second sheet supply tray 11B is "A4," which does not meet the sheet size printing condition of "B5." Accordingly, the sheet size error occurs. On the other hand, the sheet type in the second sheet supply tray 11B is "normal sheet," which meets the sheet type condition of "normal sheet," so that the sheet type error does not occur. Since there is no other errors to occur, conveying path No. 13 has only one error in which the sheet size of the second sheet supply tray 11B is incorrect. Because the error number for an incorrect sheet size of the second sheet supply tray 11B is "12" (FIG. 9), the CPU 50 stores error number "12" in the error table 210 in association with conveying path No. 13. In S16, the CPU 50 references the steps table 130 to find the total number of steps for clearing the targeted errors, and stores the total number of steps in the error table 210. The number of steps for resolving error number "12" is "5", and there are no other errors, so that the total number of steps is "5" in this example. Because other conveying path still exists (S17: YES), the process returns to S11 where the next conveying path No. 14 is selected.

In conveying path No. 14, sheet is supplied from the first sheet supply tray 11A; the duplex printing unit 25 is not used; the stapler 35 is used; and the sheet is discharged onto the second discharge tray 31. Since the duplex printing unit 25 is not used and the stapler 35 is used in the case of conveying path No. 14, the printing condition "printing surface specification" is not met, while the printing condition "binding specification" is met. However, the "printing surface specification" is set as the ignorable printing condition and is therefore excluded, so the CPU 50 determines that the conditions are met (S12:YES), and the process proceeds to S13. The number of unmet conditions is "1" in conveying path No. 14, which does not exceed the number of ignorable printing conditions "1." Accordingly, a negative determination is made in S13 (S13:NO), and then in S14, the CPU 50 stores the conveying path No. (14), the unmet conditions (printing surface specification), and the number of unmet conditions (1) in the error table 210 (FIG. 25).

In S15, the CPU 50 determines errors related to the device's status for conveying path No. 14 and stores these errors in the error table 210. Specifically, sheet is supplied from the first sheet supply tray 11A in the case of conveying path No. 14. Referencing the sheet supply tray status table 150 (FIG. 11), the sheet size in the first sheet supply tray 11A is "B5," which meets the sheet size printing condition of "B5." However, the sheet type in the first sheet supply tray 11A is "transparent sheet," which does not meet the sheet type condition of "normal sheet," so that the sheet type error occurs. Since there is no other error to occur, conveying path No. 14 has only one error in which the sheet type of the first sheet supply tray 11A is incorrect. Because the error number for an incorrect sheet type of the first sheet supply tray 11A is "7" (FIG. 9), the CPU 50 stores error number "7" in the error table 210 in association with conveying path No. 14. In S16, the CPU 50 references the steps table 130 to find the total number of steps for resolving the targeted errors, and stores the total number of steps in the error table 210. The number of steps for resolving error number "7" is "4", and there are no other errors, so that the total number of steps is "4" in this example. Because other conveying paths still exist (S17:YES), the process returns to S11 where the next conveying path No. 15 is selected.

In conveying path No. 15, sheet is supplied from the second sheet supply tray 11B; the duplex printing unit 25 is not used; the stapler 35 is used; and the sheet is discharged onto the second discharge tray 31. Since the duplex printing unit 25 is not used and the stapler 35 is used in the case of conveying path No. 15, the printing condition "printing surface specification" is not met, while the condition "binding specification" is met. However, the "printing surface specification" is the ignorable printing condition and is therefore excluded, so the CPU 50 determines that the conditions are met (S12:YES), and the process proceeds to S13. The number of unmet conditions is "1" in conveying path No. 15, which does not exceed the number of ignorable printing conditions "1." Accordingly, a negative determination is made in S13 (S13:NO), and then in S14, the CPU 50 stores the conveying path No. (15), the unmet conditions (printing surface specification), and the number of unmet conditions (1) into the error table 210 (FIG. 25).

In S15, the CPU 50 determines the errors related to the device's status for conveying path No. 15 and stores these errors in the error table 210. Specifically, sheet is supplied from the second sheet supply tray 11B in the case of conveying path No. 15. Referencing the sheet supply tray status table 150 (FIG. 11), the sheet size in the second sheet supply tray 11B is "A4," which does not meet the sheet size printing condition of "B5," so that the sheet size error occurs. The sheet type in the second sheet supply tray 11B is "normal sheet," which meets the sheet type condition of "normal sheet." Since there is no other error to occur, conveying path No. 15 has only one error in which the sheet size of the second sheet supply tray 11B is incorrect. Because the error number for an incorrect sheet size of the second sheet supply tray 11B is "12" (FIG. 9), the CPU 50 stores error number "12" in the error table 210 in association with conveying path No. 15. In S16, the CPU 50 references the steps table 130 to find the total number of steps for resolving targeted errors, and stores the total number of steps in the error table 210. The number of steps for resolving error number "12" is "5", and there are no other errors, so that the total number of steps is "5" in this example. Because other conveying path still exists (S17:YES), the process returns to S11 where the next conveying path No. 16 is selected.

In conveying path No. 16, sheet is supplied from the third sheet supply tray 11C; the duplex printing unit 25 is not used; the stapler 35 is used; and the sheet is discharged onto the second discharge tray 31. Since the duplex printing unit 25 is not used and the stapler 35 is used in the case of conveying path No. 16, the printing condition "printing surface specification" is not met, while the condition "binding specification" is met. However, the "printing surface specification" is the ignorable printing condition and is therefore excluded, so the CPU 50 determines in S12 that the conditions are met (S12:YES), and the process proceeds to S13. The number of unmet conditions is "1" in conveying path No. 16, which does not exceed the number of ignorable printing conditions "1." Accordingly, a negative determination is made in S13 (S13:NO), and then in S14, the CPU 50 stores the conveying path No. (16), the unmet conditions (printing surface specification), and the number of unmet conditions (1) in the error table 210 (FIG. 25).

In S15, the CPU 50 determines the errors related to the device's status for conveying path No. 16 and stores these errors and error numbers of these errors into the error table 210. Specifically, sheet is supplied from the third supply tray 11C in the case of conveying path No. 16. Referencing the sheet supply tray status table 150 (FIG. 11), the sheet size in the third sheet supply tray 11C is "B5," which meets the sheet size printing condition of "B5," so that the sheet size error does not occur. The sheet type in the third sheet supply tray 11C is "normal sheet," which meets the sheet type condition of "normal sheet," so that the sheet type error does not occur. However, the third paper supply tray 11C is currently out of sheets, so the sheet empty error will occur. Since there is no other error to occur, conveying path No. 16 has only one error in which the third paper supply tray 11C is out of sheets. Because the error number for the third paper supply tray 11C being out of sheets is "5" (FIG. 9), the CPU 50 stores error number "5" in the error table 210 in association with conveying path No. 16. In S16, the CPU 50 references the steps table 130 to find the total number of steps for resolving targeted errors, and stores the total number of steps in the error table 210. The number of steps for resolving error number "5" is "3", and there are no other errors, so that the total number of steps is "3" in this example. Because there is no other conveying path (S17: NO), the process proceeds to S18. Here, after completing the error determining process of FIG. 19 up to S17 in this Case 1, the error table 210*d* shown in FIG. 25 is created.

In S18, the conveying paths stored in the error table 210 are sorted in ascending order based on the number of unmet conditions. Conveying paths having the same number of unmet conditions are further sorted in ascending order based on the total number of steps. When the total number of steps are also the same, the conveying paths are sorted in ascending order based on the conveying path number. In this way, a priority level is determined for each conveying path stored in the error table 210. Conveying paths closer to the top in the sorted error table 210 have a higher priority level. When the sorting is performed in S18, an error table 210*e* shown in FIG. 26 is created in this example.

Next in S19, the CPU 50 determines whether or not a setting has been made in advance to execute a redundancy removing process. If so (S19:YES), then the redundancy removing process is executed in S20. The redundancy removing process is for eliminating all redundant conveying paths from the error table 210 that produce all of the same errors as another conveying path. The redundancy removing process is described below with reference to the flowchart of FIG. 20.

Figure 20:
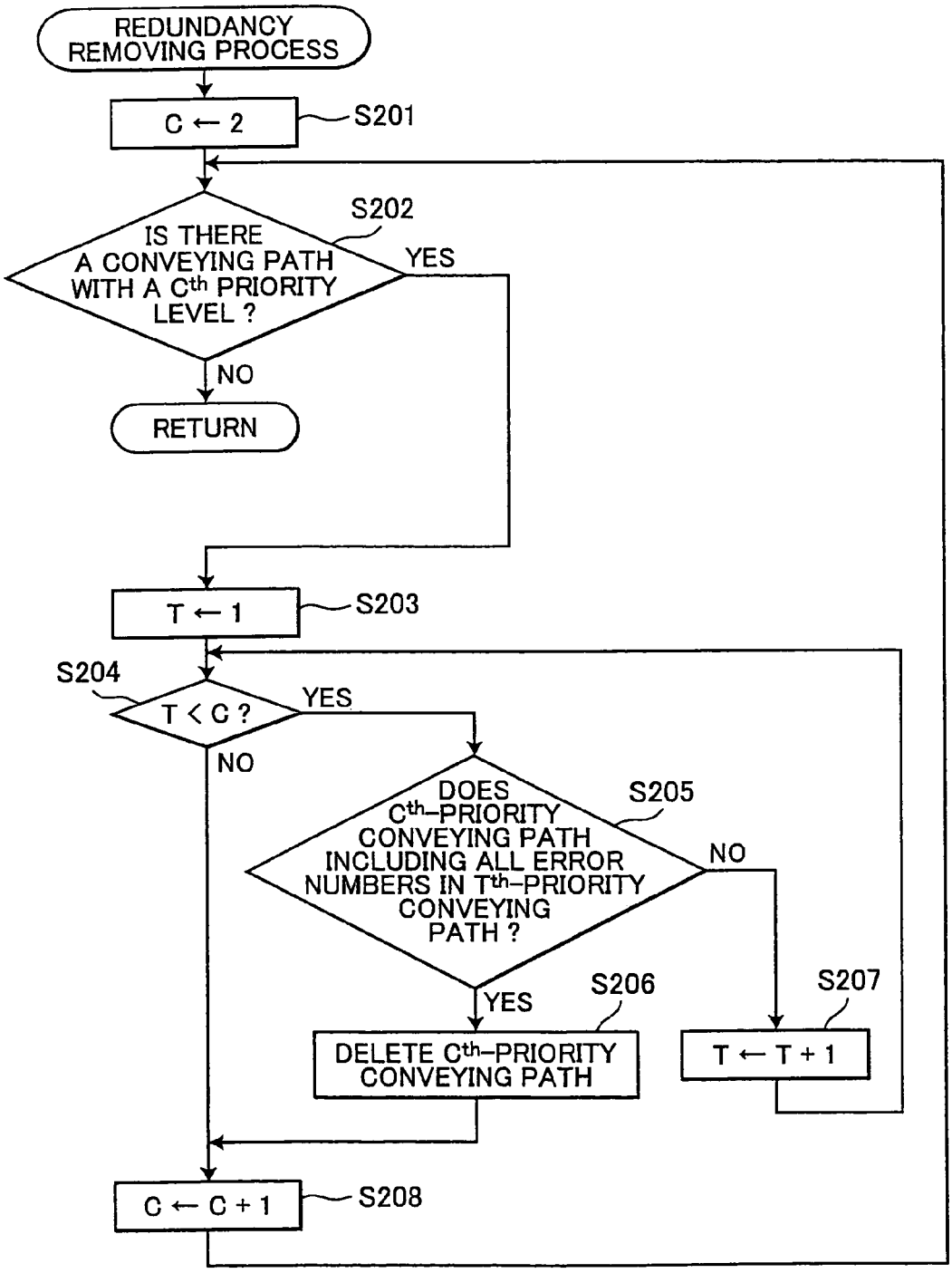
FIG. 20 is a flowchart showing a redundancy removing process.

In S201 of FIG. 20, the CPU 50 sets a value C of a priority counter to 2. In S202, the CPU 50 determines whether or not the error table 210 stores a conveying path having the $C^{th}$ highest priority level, i.e., $2^{nd}$ highest priority level in this embodiment. If so (S202:YES), then the CPU 50 sets a value T of a temporary counter to 1 in S203. In S204, the CPU 50 determines whether or not the counter value T is smaller than the counter value C. If so (S204:YES), this signifies that the $T^{th}$ conveying path has a higher priority than the $C^{th}$ conveying path. Then, in S205, the CPU 50 determines whether or not the error numbers for the conveying path having the $T^{th}$ highest priority level are all included in the error numbers for the conveying path having the $C^{th}$ highest priority level.

If so (S205:YES), then in S206, the CPU 50 deletes the conveying path having the $C^{th}$ highest priority level from the error table 210, increments counter value C by 1 in S208, and returns to S202. On the other hand, if error numbers for the conveying path having the $T^{th}$ highest priority level are not all included in the error numbers of the conveying path having the $C^{th}$ highest priority level (S205:NO), then the CPU 50 increments counter value T by 1 in S207, and the process returns to S204.

If the counter value T is not smaller than the counter value C (S204:NO), then the process proceeds to S208, where the CPU 50 increments the counter value C by 1, and the process returns to S202. If the CPU 50 determines in S202 that there is no conveying path with a $C^{th}$ highest priority level stored in the error table 210 (S202:NO), then the redundancy removing process ends. Executing the redundancy removing process in this example on the error table 210*e* deletes conveying paths Nos. 14 and 15. As a result, an error table 210*f* is created as shown in FIG. 27 with conveying paths sorted in the order of Nos. 12, 13, and 16.

Figure 19:
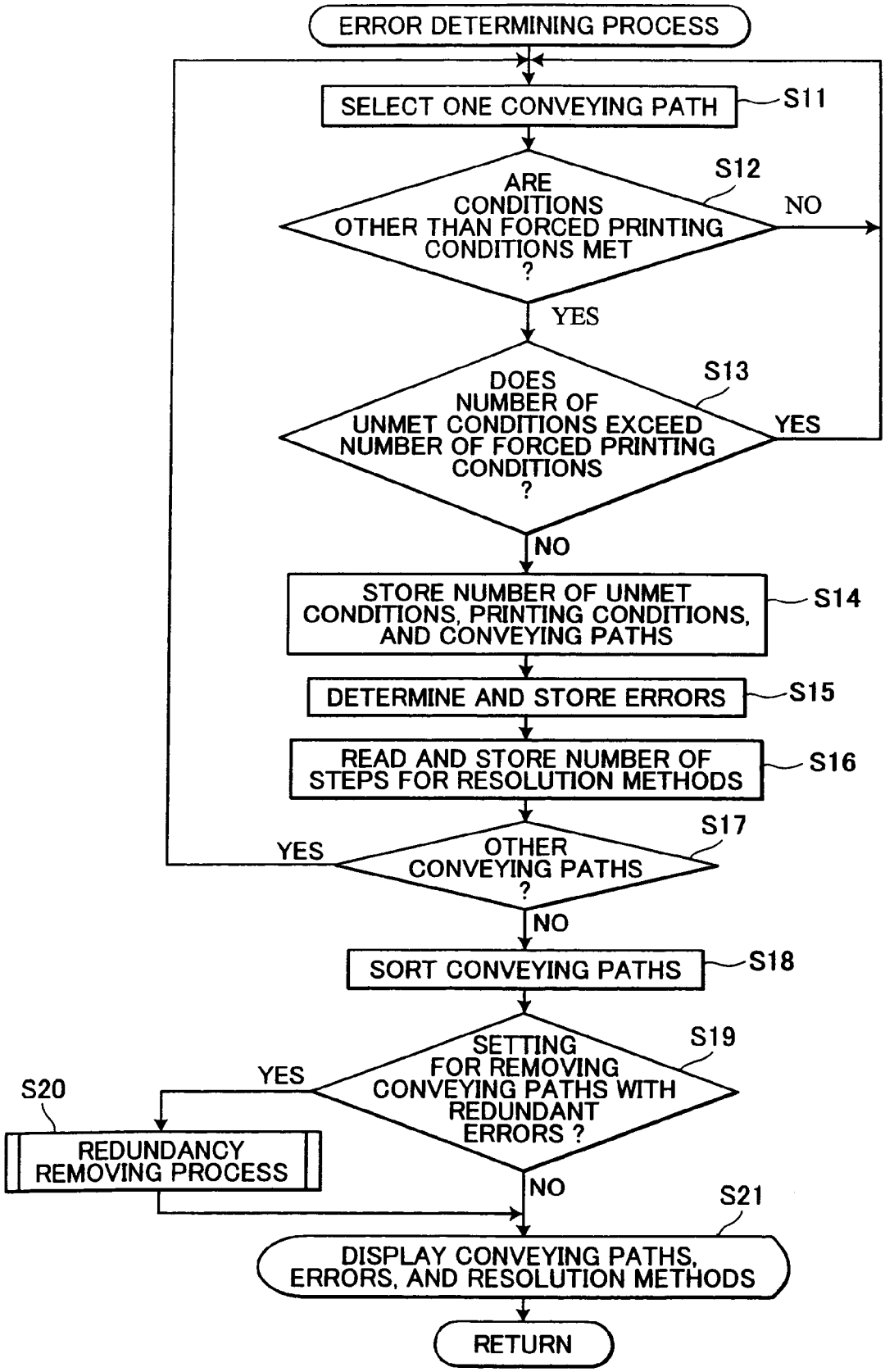
FIG. 19 is a flowchart showing an error determining process.

After completing the redundancy removing process in S20 of FIG. 19, the process advances to S21. If the CPU 50 determines in S19 that the setting for the redundancy removing process has not been selected (S19:NO), then the process directly proceeds to S21 without executing the redundancy removing process. In S21, the CPU 50 displays the conveying paths on the display unit 76 along with the cause of errors on each conveying path and their methods of resolution based on the error table 210 (error table 210*f* in this example).

Figure 28:
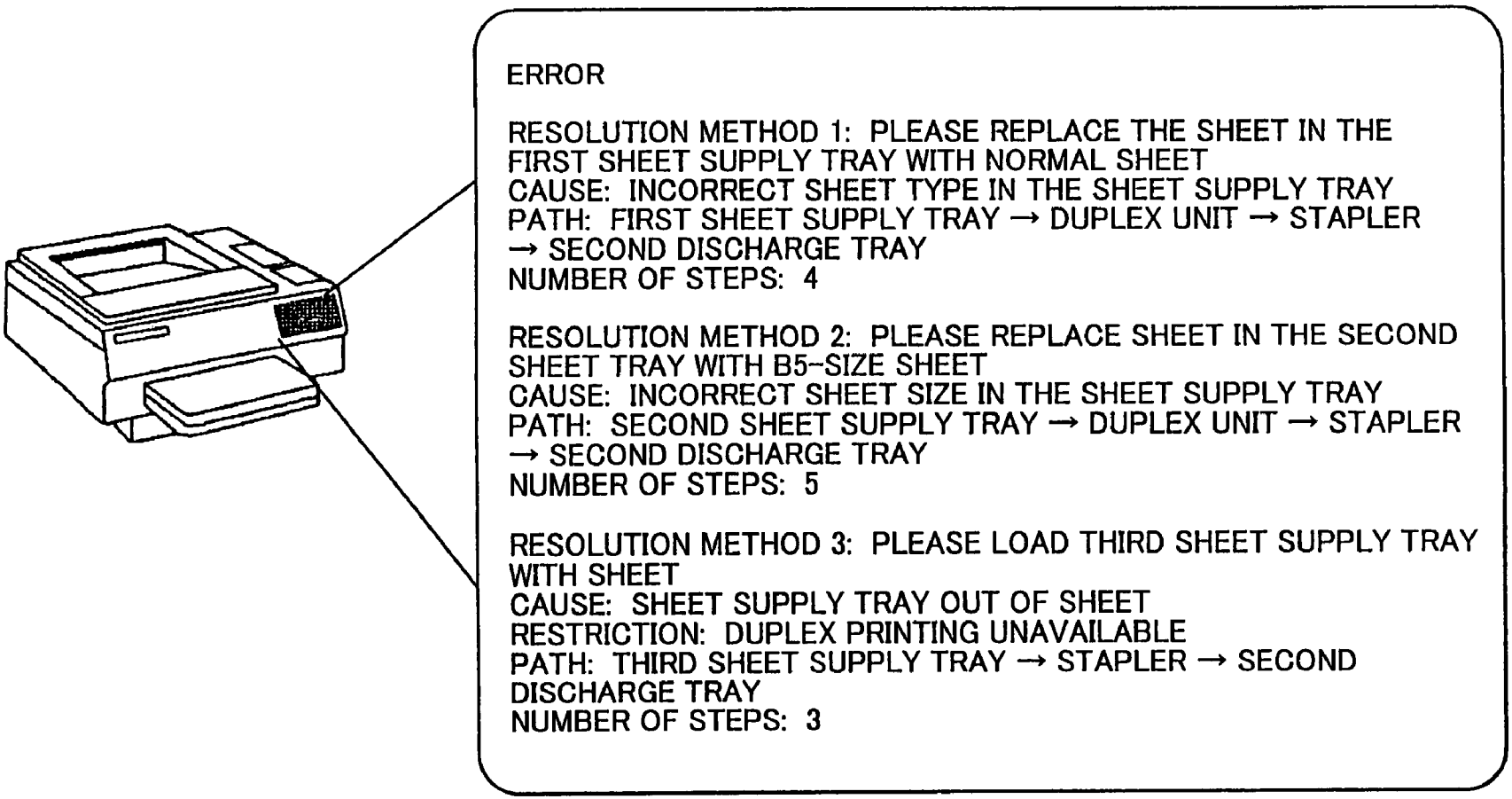
FIG. 28 is an explanatory diagram of an example error display on the display unit.

Specifically, in this example, resolution methods 1 through 3 are displayed in S21 in order from the top of the display unit 76 as shown in FIG. 28. Data displayed for resolution method 1 includes "resolution method 1:please replace the sheet in the first sheet supply tray with normal sheet," "cause:incorrect sheet type in the sheet supply tray," "path:first sheet supply tray→duplex unit→stapler→second discharge tray," "number of steps:4." In this case, the user can clear the error simply by performing 4-step operation as indicated for replacing sheet in the first sheet supply tray 11A with normal sheet.

Data displayed for resolution method 2 includes "resolution method 2:please replace sheet in the second sheet tray with B5-size sheet," "cause:incorrect sheet size in sheet supply tray," "path:second sheet supply tray→duplex unit→stapler→second discharge tray," "number of steps:5." In this case, the user can clear the error by performing the indicated 5-step operation to replace sheet in the second sheet supply tray 11B with B5-size sheet.

Data displayed for resolution method 3 includes "resolution method 3:please load third sheet supply tray with sheets," "cause:sheet supply tray out of sheet," "restriction: duplex printing unavailable," "path:third sheet supply tray→stapler→second discharge tray," "number of steps:3." In this case, the user can clear the error by loading the third sheet supply tray 11C with sheet as specified, but cannot perform duplex printing.

Here, the resolution methods are classified into a complete resolution method associated with no restriction, such as the resolution methods 1 and 2, and a limited resolution method associated with restriction, such as the resolution method 3 shown in FIG. 28. The resolution methods are displayed on the display unit giving priority to complete resolution methods over limited resolution methods.

Returning to FIG. 19, after completing the process in S21, the CPU 50 ends the error determining process, and the process advances to S7 of FIG. 18. In S7, the CPU 50 determines whether or not the status of the laser printer 1 has changed. If the status has not changed (S7:NO), then the CPU 50 waits until the status changes. When the status has changed (S7:YES), then the process returns to S4. If a printable conveying path exists that satisfies the user's specifications (S4:YES), then the CPU 50 executes the printing process in S5 ends the current process.

Below, other examples of the error table 210 and the data displayed on the display unit 76 will be described as separate cases (Cases 2–6) with reference to FIGS. 21 through 45.

(Case 2)

In Case 2, the finishing device 36 is provided; the number of ignorable printing conditions is "0"; no printing condition is set as the ignorable printing condition; and the printing conditions set by the user are shown in FIG. 10(*a*).

With these conditions, the error table 210 shown in FIG. 21 is created after the error determining process of FIG. 19 has been completed up to S17. After the sorting is performed in S18, the error table 210*b* shown in FIG. 22 is created. Since the number of unmet printing conditions is "0" for each entry, conveying paths are sorted in ascending order of total number of steps. When entries have the same total number of steps, the conveying paths are further sorted in ascending order of conveying path number. When the redundancy removing process of S21 is performed on the error table 210*b*, conveying paths Nos. 9, 5, and 7 are removed, forming an error table 210*c* shown in FIG. 23 with the ordered conveying paths Nos. 11, 10, 6, and 8.

Figure 24:
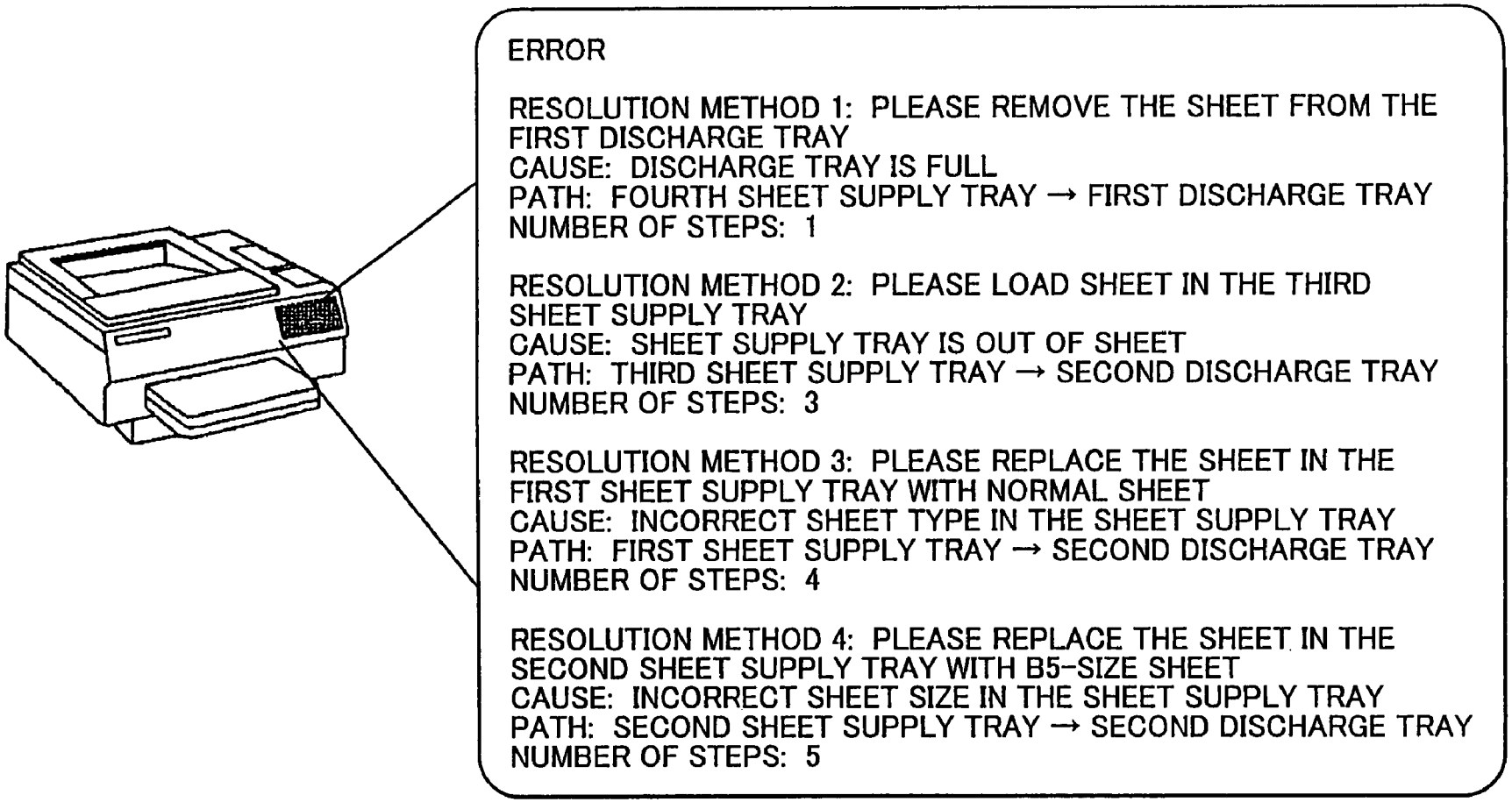
FIG. 24 is an explanatory diagram of an example error display on a display unit.

In S21 resolution methods 1 through 4 are displayed in this order based on the error table 210*c* beginning from the top of the display unit 76, as shown in FIG. 24. Data displayed for resolution method 1 includes "resolution method 1:please remove the sheet from the first discharge tray," "cause:discharge tray is full," "path:fourth sheet supply tray→first discharge tray," "number of steps:1." In this case, the user can clear the error simply by performing a 1-step operation to remove sheet from the first discharge tray 30 as directed. In other words, the directions displayed in the top paragraph indicate the method of resolution that the user can perform with the least amount of trouble.

Data displayed for resolution method 2 includes "resolution method 2:please load sheet in the third sheet supply tray," "cause:sheet supply tray is out of sheet," "path:third sheet supply tray→second discharge tray," "number of steps:3." In this case, the user can clear the error by performing a 3-step operation as directed to load sheet into the third sheet supply tray 11C.

Data displayed for resolution method 3 includes "resolution method 3:please replace the sheet in the first sheet supply tray with normal sheet," "cause:incorrect sheet type in the sheet supply tray," "path:first sheet supply tray→second discharge tray," "number of steps:4." In this case, the user can clear the error by performing a 4-step operation as directed to replace sheet in the first sheet supply tray 11A with normal sheet.

Data displayed for resolution method 4 includes "resolution method 4:please replace the sheet in the second sheet supply tray with B5-size sheet," "cause:incorrect sheet size in the sheet supply tray," "path:second sheet supply tray→second discharge tray," "number of steps:5." In this case, the user can clear the error by performing a 5-step operation as directed by replacing sheet in the second discharge tray 11B with B5-size sheet.

(Case 3)

Case 3 assumes that the finishing device 36 is provided; the number of ignorable printing conditions is "2"; the ignorable printing conditions are "printing surface specification" and "binding specification"; and the printing conditions set by the user are that shown in FIG. 10(*b*).

With these conditions, an error table 210*g* shown in FIG. 29 is created after completing the error determining process of FIG. 19 up to S17. After the ordering is performed in S18, an error table 210*h* shown in FIG. 30 is created. Hence, conveying paths are ordered according to the number of unmet printing conditions "0", "1", and "2". Conveying paths having the same number of unmet conditions are sorted in ascending order by total number of steps. Conveying paths with the same total number of steps are further sorted in ascending order of conveying path number. When the redundancy removing process of S20 is performed on the error table 210*h*, conveying paths Nos. 2, 14, 1, 4, 15, 3, 10, 6, 9, 5, 8, and 7 are deleted, forming an error table 210*i* shown in FIG. 31 with the ordered conveying paths Nos. 12, 13, 16, and 11.

In S21, resolution methods 1 through 4 ordered based on the error table 210*i* are displayed beginning from the top of the display unit 76, as shown in FIG. 32. Data displayed for resolution method 1 includes "resolution method 1:please replace the sheet in the first sheet supply tray with normal sheet," "cause:incorrect sheet type in the sheet supply tray," "path:first sheet supply tray→duplex unit→stapler→second discharge tray," "number of steps:4." In this case, the user can clear the error simply by performing a 4-step operation as directed to replace the sheet in the first sheet supply tray 11A with normal sheet.

Data displayed for resolution method 2 includes "resolution method 2:please replace the sheet in the second sheet supply tray with B5-size sheet," "cause:incorrect sheet size in the sheet supply tray," "path:second sheet supply tray→duplex unit→stapler→second discharge tray," "number of steps:5." In this case, the user can clear the error by performing a 5-step operation as directed to replace sheet in the second sheet supply tray 11B with B5-size sheet.

Data displayed for resolution method 3 includes "resolution method 3:please load sheet into the third sheet supply tray," "cause:sheet supply tray is out of sheet," "restriction: duplex print unavailable," "path:third sheet supply tray→stapler→second discharge tray," "number of steps:3" In this case, the user can clear the error by performing a 3-step operation as directed to load sheet into the third sheet supply tray 11C, but cannot perform a duplex printing operation.

Data displayed for resolution method 4 includes "resolution method 4:please remove the sheet in the first discharge tray," "cause:discharge tray is full," "restriction:duplex printing unavailable; binding unavailable," "path:fourth sheet supply tray→first discharge tray," "number of steps: 1." In this case, the user can clear the error by performing the number of steps 4 operation as directed to remove sheet from the first discharge tray 30. However, the user cannot perform a duplex printing operation nor a binding operation.

(Case 4)

Case 4 assumes that the finishing device 36 is not provided; the number of ignorable printing conditions is "0"; the ignorable printing condition is "none"; and the printing conditions set by the user are shown in FIG. 10(*a*). In this case, the conveying path table 200 shown in FIG. 16, rather than the conveying path table 190, is referenced by since the finishing device 36 is not mounted on the main casing 1*a*.

With these conditions, an error table 210*j* shown in FIG. 33 is created after completing the error determining process of FIG. 19 up to S17. After the sorting performed in S18, an error table 210*k* shown in FIG. 34 is created. Since the number of unmet printing conditions is "0", conveying paths are sorted in ascending order of total number of steps.

Figure 37:
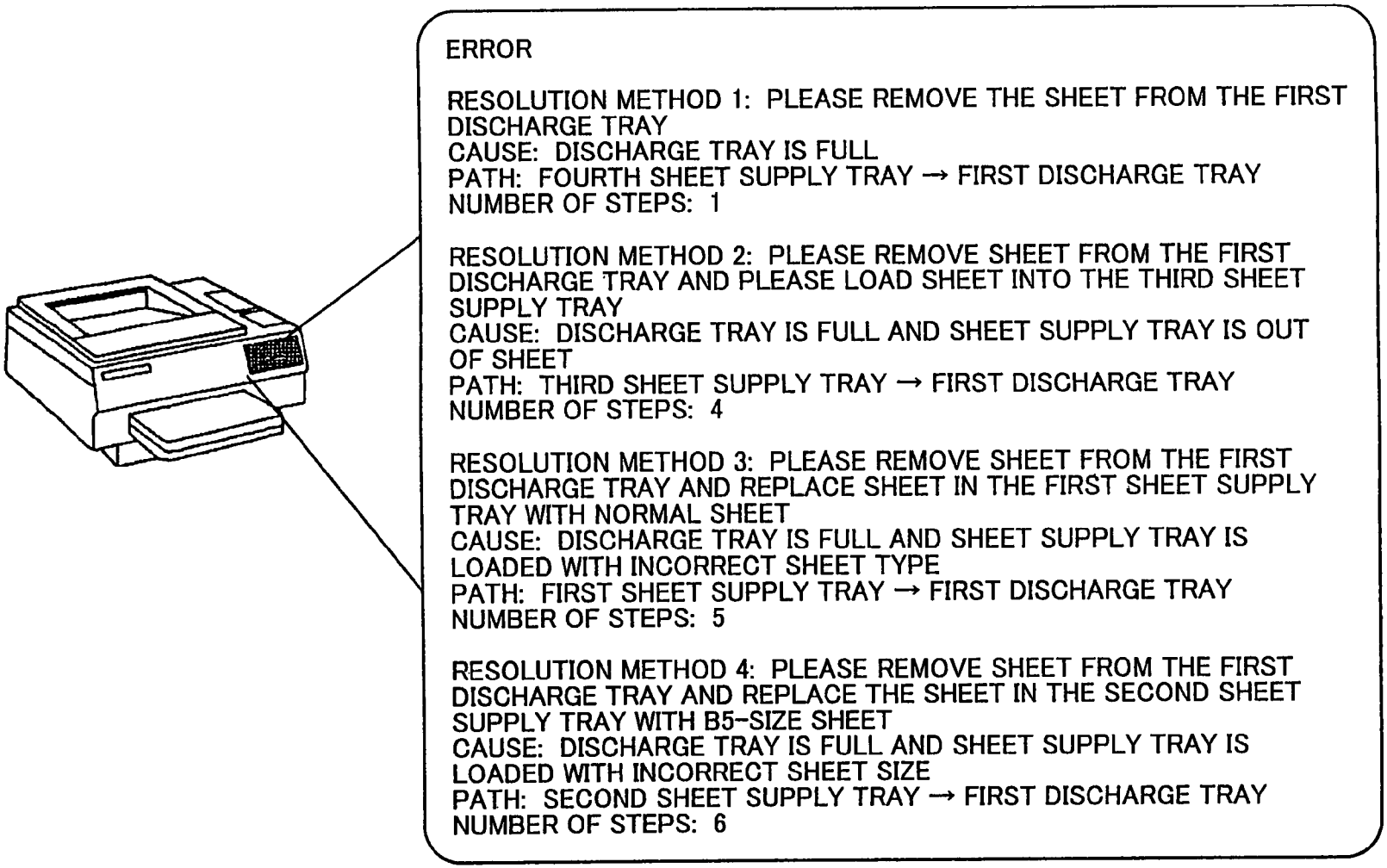
FIG. 37 is an explanatory diagram of an example error display on the display unit.

If the redundancy removing process is not performed (S19:NO), then resolution methods 1 through 4 are displayed on the display unit 76 as shown in FIG. 37 based on the error table 210*k* shown in FIG. 34. Data displayed for resolution method 1 includes "resolution method 1:please remove the sheet from the first discharge tray," "cause: discharge tray is full," "path:fourth sheet supply tray→first discharge tray," "number of steps:1." In this case, the user can clear the error simply by performing 1-step operation as directed to remove the sheet from the first discharge tray 30.

Data displayed for resolution method 2 includes "resolution method 2:please remove sheet from the first discharge tray and please load sheet into the third sheet supply tray," "cause;discharge tray is full and sheet supply tray is out of sheet," "path:third sheet supply tray→first discharge tray," "number of steps:4." In this case, the user can clear the error by performing a 4-step operation as directed to remove sheet from the first discharge tray 30 and load sheet into the third sheet supply tray 11C.

Data displayed for resolution method 3 includes "resolution method 3:please remove sheet from the first discharge tray and replace sheet in the first sheet supply tray with normal sheet," "cause:discharge tray is full and sheet supply tray is loaded with incorrect sheet type," "path:first sheet supply tray→first discharge tray," "number of steps:5." In this case, the user can clear the error by performing a 5-step operation as directed to remove sheet from the first discharge tray 30 and replace sheet in the first sheet supply tray 11A with normal sheet.

Data displayed for resolution method 4 includes "resolution method 4:please remove sheet from the first discharge tray and replace the sheet in the second sheet supply tray with B5-size sheet," "cause:discharge tray is full and sheet supply tray is loaded with incorrect sheet size," "path: second sheet supply tray→first discharge tray," "number of steps:6." In this case the user can clear the error by performing a 6-step operation as indicated to remove sheet from the first discharge tray 30 and replace the sheet in the second sheet supply tray 11B with B5-size sheet.

Figures 36, 38:
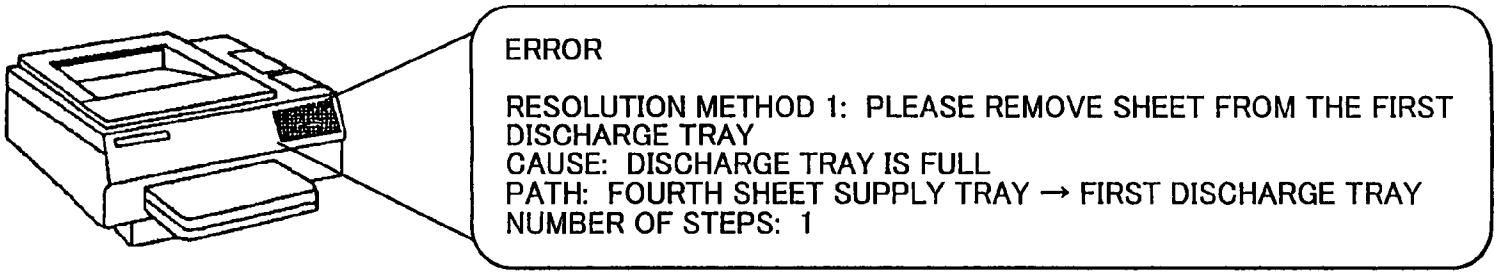
FIG. 36 is an explanatory diagram of an example error display on the display unit.
FIG. 38 is an explanatory diagram of the error table.

However, if the redundancy removing process of S20 is performed on the error table 210*k*, conveying paths Nos. 9, 5, and 7 are removed, thereby creating an error table 210*m* shown in FIG. 35 that includes only conveying path No. 11. Then, in S21, resolution method 1 including "resolution method 1:please remove sheet from the first discharge tray," "cause:discharge tray is full," "path:fourth sheet supply tray→first discharge tray," "number of steps:1" is displayed in the display unit 76, as shown in FIG. 36, based on the error table 210*m*. In this case, the user can clear the error simply by performing a 1-step operation as directed to remove sheet from the first discharge tray 30.

(Case 5)

Case 5 assumes that the finishing device 36 is not provided; the number of ignorable printing conditions is "0"; the ignorable printing condition is "none"; and the printing conditions are set by the user as shown in FIG. 10(*b*).

With these conditions, and error table 210*n* having no resolution methods is created as shown in FIG. 38 after completing the error determining process of FIG. 19 up to S17. An error table 210*o* shown in FIG. 39 is created after the sorting operation of S18, and an error table 210*p* shown in FIG. 40 is formed by performing the redundancy removing process of S20.

In S21 "resolution method 1:please press the cancel key," "cause:no resolution method exists" is displayed based on the error table 210*p* in the display unit 76, as shown in FIG. 41. In this case there is no method of resolution.

(Case 6)

Next, Case 6 will be described. Here, Case 6 is similar to Case 3 described above. However, in Case 6, it is assumed that sheet in the first discharge tray 30 has been removed according to resolution method 4 shown in FIG. 32. When the sheet is removed from the first discharge tray 30 in this way, the CPU 50 determines a change in status in S7, and the process returns to S4. In this example, the CPU 50 determines that there is no printable conveying path that satisfies the user-specified printing conditions (S4:NO), and executes the error determining process in S6. After the error determining process is executed up to S17, an error table 210*q* shown in FIG. 42 is created. Next, an error table 210*r* shown in FIG. 43 is created from the sorting process of S18. Conveying paths are sorted first according to the number of printing conditions "0", "1", and "2" and are further sorted in ascending order of total number of steps. Conveying paths having the same total number of steps are sorted in ascending order of conveying path number. When performing the redundancy removing process of S20, conveying paths Nos. 1, 2, 14, 3, 4, 15, 9, 10, 5, 6, 7, and 8 are removed, resulting in an error table 210*s* shown in FIG. 44 with ordered conveying paths Nos. 12, 13, 16, and 11.

In S21, resolution methods 1 through 4 ordered according to error table 210*s* are displayed beginning from the top of the display unit 76, as shown in FIG. 45. Data displayed for resolution method 1 includes "resolution method 1:please replace the sheet in the first sheet supply tray with normal sheet," "cause:incorrect sheet type in the sheet supply tray," "path:first sheet supply tray→duplex unit→stapler→second discharge tray," "number of steps:4." In this case, the user can clear the error simply by performing a 4-step operation as directed to replace the sheet in first sheet supply tray 11A with normal sheet.

Data displayed for resolution method 2 includes "resolution method 2:please replace the sheet in the second sheet supply tray with B5-size sheet," "cause:incorrect sheet size in the sheet supply tray," "path:second sheet supply tray→duplex unit→stapler→second discharge tray," "number of steps:5." In this case, the user can clear the error by performing a 5-step operation as indicated to replace the sheet in the second sheet supply tray 11B with B5-size sheet.

Data displayed for resolution method 3 includes "resolution method 3:please load sheet into the third sheet supply tray," "cause:sheet supply tray is out of sheet," "restriction: duplex printing is unavailable," "path:third sheet supply tray→stapler→second discharge tray," "number of steps:3." In this case, the user can clear the error by performing a 3-step operation as directed to load sheet into the third sheet supply tray 11C, but cannot perform duplex printing.

Data displayed for resolution method 4 includes "resolution method 4:please press the Go key," "cause:the device is trouble-free," "restriction:duplex printing is unavailable and binding is unavailable," "path:fourth sheet supply tray→first discharge tray," "number of steps:0." In this case, the user can clear the error by performing a 0-step operation of pressing the Go button 81 as directed. However, the user cannot perform a duplex printing or binding operation.

As described above, the laser printer 1 according to the preferred embodiment can detect errors related to each conveying path and displays resolution methods on the display panel 76 in order of highest priority. For example, resolution methods can be displayed on the display unit giving priority to complete resolution methods over limited resolution methods. Resolution methods can also be displayed on the display unit with priority given to limited resolution methods having a fewer number of unresolved errors over limited resolution methods having a larger number of unresolved errors. Further, the number of steps can also be stored with each resolution method, enabling methods to be displayed with priority given to those methods having the lowest number of steps when a plurality of resolution methods exists. Therefore, the user can readily find and select the optimal resolution method with the lowest number of steps capable of satisfying the user's request.

Because all of the errors on each conveying path are displayed at the same time, the user can grasp the overall condition of each conveying path and can easily select the optimal resolution method. This contrast to the conventional technique, where errors on the same conveying path are displayed one after the other, e.g., a discharge error is displayed only after a supply error on the same conveying path is cleared.

The user can set ignorable printing conditions and the number of ignorable printing conditions if it is not necessary to completely satisfy user-specified printing conditions when executing printing, thereby obtaining a limited resolution method. By setting ignorable printing conditions and the number of ignorable printing conditions, a portion of errors can be excluded as unresolved errors, thereby regulating the limited resolution methods provided to the user.

The redundancy removing process can provide a more readable display to the user by removing conveying paths having the same error causes.

The conveying paths and errors are displayed on the display panel 76 in addition to resolution methods. Also, when displaying limited resolution methods, data related to processing paths, data related to errors excluded as unresolved errors are also displayed. Therefore, the user can view data related to the conveying path, the errors, and the like, not just the resolution method.

Although in the above examples, the number of the user-specified ignorable printing condition was equal to the user-specified number of ignorable printing condition. However, the user can specify any number as the number of ignorable printing condition regardless of the number of user-specified ignorable printing condition.

While some exemplary embodiments of this invention have been described in detail, those skilled in the art will recognize that there are many possible modifications and variations which may be made in these exemplary embodiments while yet retaining many of the novel features and advantages of the invention.

For example, in the above-described embodiment, a recording sheet is used as an example of a processing medium. However, the processing medium is not limited to a recording sheet but could be cloth, compact disk, or the like, as long as it is possible to print images on its surface.

In the above described embodiment, both an ignorable printing condition and a number of ignorable printing condition are specified by the user. However, it is possible to modify the above embodiment to enable the user to specify only the number of ignorable printing condition. In this case, one or more of printing conditions could be excluded regardless of type of the printing conditions as long as the number of excluding printing conditions does not exceed the specified number.

What is claimed is:

1. A processing medium conveying device comprising:

a plurality of processing units;

a specifying unit that specifies at least one of processing conditions including processing paths and characteristics of a processing medium, each processing path being defined by a combination of two or more of the processing units;

a status detecting unit that detects status of each processing unit;

a determining unit that determines based on the detected status whether a process according to the specified processing condition is performable;

a selecting unit that selects a plurality of the processing paths based both on the detected status and on the specified processing condition when the determining unit determines that the process is not performable;

an error detecting unit that detects all errors that will occur on the selected processing paths;

a memory that stores resolution methods for clearing errors;

a displaying unit; and a controller that reads resolution methods for clearing the detected errors from the memory and displays at least one of the resolution methods read from the memory on the displaying unit as a comprehensive resolution method.

2. The processing medium conveying device according to claim 1, wherein the processing units include a plurality of process units and a passage unit that transports the processing medium between two of the process units.

3. The processing medium conveying device according to claim 1, further comprising a second memory that stores capacity of the processing units, wherein the error detecting unit detects errors based on the detected status, on the capacity stored in the second memory, and on the specified processing condition.

4. The processing medium conveying device according to claim 3, further comprising an updating unit that updates the capacity stored in the second memory when the capacity changes.

5. The processing medium conveying device according to claim 1, wherein the controller displays at least one of data regarding the processing paths and data regarding the errors along with the comprehensive resolution method on the displaying unit.

6. The processing medium conveying device according to claim 5, wherein the data regarding the processing paths is data regarding the processing units defining the processing paths on which errors were detected.

7. The processing medium conveying device according to claim 5, wherein the data regarding the errors is data regarding the type of error.

8. The processing medium conveying device according to claim 1, wherein when there are a plurality of comprehensive resolution methods, the controller displays the comprehensive resolution method on the displaying unit according to priority levels of the comprehensive resolution methods.

9. The processing medium conveying device according to claim 8, wherein the first memory stores a priority level of each resolution method; and the controller displays the comprehensive resolution methods according to priority levels obtained by calculating priority levels of the resolution methods.

10. The processing medium conveying device according to claim 9, wherein each priority level of the resolution method is a number of steps to clear the corresponding error.

11. The processing medium conveying device according to claim 9, further comprising a changing unit that changes the priority levels stored in the first memory.

12. The processing medium conveying device according to claim 8, wherein the controller displays the comprehensive resolution methods and the priority levels of the comprehensive resolution methods on the displaying unit.

13. The processing medium conveying device according to claim 8, wherein:

the specifying unit further specifies an ignorable processing condition through operations of the user;

the selecting unit selects the plurality of the processing paths based further on the ignorable processing condition;

the controller displays the comprehensive resolution method on the displaying unit based further on the ignorable processing condition; and the comprehensive resolution methods are classified into a complete method and a limited method, each complete method providing a method to clear all the errors on a corresponding processing path, each limited method providing a method to clear the errors on a corresponding processing path excluding an unresolved error that is related to the ignorable processing condition.

14. The processing medium conveying device according to claim 13, wherein the priority level of the complete method is higher than the priority level of the limited method.

15. The processing medium conveying device according to claim 13, wherein a priority level of a limited method for a processing path having a fewer number of unresolved errors is higher than a priority level of a limited method for a processing path having a larger number of unresolved errors.

16. The processing medium conveying device according to claim 13, wherein the controller displays, on the display unit, data regarding the ignorable processing condition along with the limited method.

17. The processing medium conveying device according to claim 1, wherein the specifying unit further specifies a desired number; and the comprehensive resolution methods are classified into a complete method and a limited method, each complete method providing a method to clear all the errors on a corresponding processing path, each limited method providing a method to clear the errors on a corresponding processing path excluding a number of unresolved errors equal to or less than the desired number.

18. The processing medium conveying device according to claim 1, wherein each comprehensive resolution method requires one or more steps, and the controller identifies a comprehensive resolution method that requires all steps required by other comprehensive resolution method and displays the comprehensive resolution methods on the displaying unit excluding the identified comprehensive resolution method.

19. An image forming device comprising:

the processing medium conveying device of claim 1, wherein the processing units of the processing medium conveying device include:

a printing unit that prints images on a processing medium;

a supplying unit that supplies the processing medium to the printing unit; and a discharging unit onto which the processing medium is discharged after the processing medium has been printed in the printing unit.

20. A processing medium conveying device comprising:

a plurality of processing units;

a specifying unit that specifies at least one of processing conditions including processing paths and characteristics of a processing medium, each processing path being defined by a combination of two or more of the processing units;

a status detecting unit that detects status of each processing unit;

a determining unit that determines based on the detected status whether a process according to the specified processing condition is performable;

a selecting unit that selects a plurality of the processing paths based both on the detected status and on the specified processing condition when the determining unit determines that the process is not performable;

an error detecting unit that detects an error that will occur on the processing paths, the error detecting unit detecting at least one error on each of the selected processing paths;

a first memory that stores resolution methods for clearing errors;

a displaying unit; and a controller that reads, from the first memory, a plurality of resolution methods each for a corresponding one of the detected errors and displays a plurality of comprehensive resolution methods on the displaying unit based on the read resolution methods.

21. The processing medium conveying device according to claim 20, wherein the processing units include a plurality of process units and a passage unit that transports the processing medium between two of the process units.

22. The processing medium conveying device according to claim 20, further comprising a second memory that stores capacity of the processing units, wherein the error detecting unit detects errors based on the detected status, on the capacity stored in the second memory, and on the specified processing condition.

23. The processing medium conveying device according to claim 20, wherein the controller displays the comprehensive resolution methods on the displaying unit according to priority levels of the comprehensive resolution methods.

24. The processing medium conveying device according to claim 20, wherein each comprehensive resolution method requires one or more steps, and the controller identifies a comprehensive resolution method that requires all steps required by other comprehensive resolution method and displays the comprehensive resolution methods on the displaying unit excluding the identified comprehensive resolution method.

25. An image forming device comprising:

the processing medium conveying device of claim 20, wherein the processing units of the processing medium conveying device include:

a printing unit that prints images on a processing medium;

a supplying unit that supplies the processing medium to the printing unit; and a discharging unit onto which the processing medium is discharged after the processing medium has been printed in the printing unit.

* * * * *